US009393797B2

(12) United States Patent
Kobayashi et al.

(10) Patent No.: US 9,393,797 B2
(45) Date of Patent: Jul. 19, 2016

(54) TERMINAL UNIT, INK SUPPLY UNIT, AND ADAPTER

(71) Applicant: SEIKO EPSON CORPORATION, Tokyo (JP)

(72) Inventors: Atsushi Kobayashi, Nagano (JP); Izumi Nozawa, Nagano (JP); Tadahiro Mizutani, Nagano (JP); Hiroyuki Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/728,159

(22) Filed: Jun. 2, 2015

(65) Prior Publication Data

US 2015/0266304 A1 Sep. 24, 2015

Related U.S. Application Data

(63) Continuation of application No. PCT/JP2013/007046, filed on Dec. 2, 2013.

(30) Foreign Application Priority Data

Dec. 7, 2012 (JP) ..... 2012-268386

(51) Int. Cl.
*B41J 2/175* (2006.01)
*B41J 29/02* (2006.01)
*B41J 29/13* (2006.01)

(52) U.S. Cl.
CPC ..... *B41J 2/17523* (2013.01); *B41J 2/1752* (2013.01); *B41J 2/17509* (2013.01); *B41J 2/17526* (2013.01); *B41J 29/02* (2013.01); *B41J 29/13* (2013.01)

(58) Field of Classification Search
CPC ..... B41J 2/175; B41J 2/17509; B41J 2/1752; B41J 2/17523; B41J 2/17526; B41J 2/17546; B41J 2/17553
USPC ..... 347/7, 49, 50, 86, 85
See application file for complete search history.

(56) References Cited

U.S. PATENT DOCUMENTS 4,368,478 A * 1/1983 Koto ..... B41J 2/19 347/86
5,023,629 A * 6/1991 Kiyohara ..... B41J 2/175 347/36
5,671,000 A * 9/1997 Hirabayashi ..... B41J 2/17526 347/50

(Continued)

FOREIGN PATENT DOCUMENTS

JP 2001-058418 A 3/2001
JP 2002-046286 A 2/2002

(Continued)

OTHER PUBLICATIONS

International Search Report for International Application No. PCT/JP2013/007046; mailed Mar. 4, 2014.

*Primary Examiner* — Anh T. N. Vo
(74) *Attorney, Agent, or Firm* — Global IP Counselors, LLP

(57) ABSTRACT

A terminal unit is mountable on a cartridge holder including an ink inlet, which draws in ink supplied to an ink ejection head and is located in an inner bottom surface of an accommodation unit that is capable of accommodating an ink cartridge, an electrical connection portion, an accommodation unit positioning portion, and a lever including a restriction portion capable of restricting movement of the ink cartridge when accommodated in the accommodation unit in a direction in which the ink cartridge is removed from the accommodation unit. When the terminal unit is mounted on the cartridge holder, a terminal group contacts the electrical connection portion, an engaging portion is engaged with the restriction portion of the lever, and a unit positioning portion is positioned by the accommodation unit positioning portion.

18 Claims, 14 Drawing Sheets

(56) References Cited

U.S. PATENT DOCUMENTS

| | | | | |
|---|---|---|---|---|
| 6,520,625 | B1 | 2/2003 | Kawakami | |
| 6,702,427 | B2 * | 3/2004 | Shimizu | B41J 2/17513 347/50 |
| 8,297,739 | B1 * | 10/2012 | Kodama | B41J 2/1752 347/49 |
| 8,628,179 | B2 * | 1/2014 | Anma | B41J 2/17546 347/49 |
| 2005/0151811 | A1 | 7/2005 | Shimizu et al. | |
| 2006/0203045 | A1 | 9/2006 | Kobayashi et al. | |
| 2009/0027469 | A1 | 1/2009 | Furukawa | |

FOREIGN PATENT DOCUMENTS

| | | | |
|---|---|---|---|
| JP | 2006-224529 | A | 8/2006 |
| JP | 2007-230249 | A | 9/2007 |
| JP | 2009-028979 | A | 2/2009 |

* cited by examiner

TERMINAL UNIT, INK SUPPLY UNIT, AND ADAPTER

The entire disclosure of Japanese Patent Application No. 2012-268386, filed Dec. 7, 2012 is expressly incorporated by reference herein.

BACKGROUND

1. Technical Field

The present invention relates to a terminal unit, an ink supply unit, and an adapter that can be mounted, for example, on a cartridge holder of an inkjet printer.

2. Related Art

Known inkjet printers generally perform printing by ejecting ink from a recording head onto a paper. Such a printer includes a cartridge holder on which an ink cartridge containing ink is mounted. Ink is supplied from the ink cartridge to the recording head through an ink supply needle arranged in the cartridge holder. The supplied ink is ejected from the recording head onto the paper to perform printing.

In such a printer, when a relatively large amount of printing is performed, ink may be supplied from an ink tank that contains more ink than an ink cartridge to continuously and stably supply ink to the recording head.

For example, Japanese Laid-Open Patent Publication No. 2006-224529 describes a configuration in which an attachment is mounted on a cartridge holder. The attachment is in the form of a cartridge including a case that receives an ink supplying tube. A circuit substrate is attached to a side surface of the case. Ink is supplied from the outside to an ink supply needle of the printer through the attachment and the ink supplying tube. As a configuration that continuously supplies ink from the outside with further ease, the ink supplying tube may be directly connected to the ink supply needle without using the attachment.

In a printer such as that described above, when the ink cartridge or the cartridge-form attachment is mounted on the cartridge holder, the circuit substrate (terminal group) arranged on the side surface of the case of the ink cartridge or the like is usually connected to a terminal portion (electrical connection portion) of the cartridge holder.

Predetermined information (e.g., identification data of ink cartridge, data of remaining amount of ink, etc.) is read from the circuit substrate. Based on the predetermined information, the printer performs printing, that is, ink is ejected from the recording head.

However, in a configuration that supplies ink from the ink supplying tube to the ink supply needle without using the cartridge-form attachment having the circuit substrate attached to the side surface of the case, the predetermined information is not read from the circuit substrate. Thus, printing cannot be performed even if ink is supplied.

SUMMARY

Accordingly, an advantage of the present invention is to provide a terminal unit that may be connected in a satisfactory manner to an electrical connection portion of a cartridge holder to transmit necessary information and enable stable printing operation with an ink ejection head, to provide an ink supply unit that smoothly supplies ink to an ink inlet that is in communication with an ink ejection head and enable stable printing, or to provide an adapter that has both of these functions.

Means for solving the problem described above and the operation effects thereof will be described below.

A terminal unit that solves the above problem is mountable on a cartridge holder including an ink inlet, which draws in ink supplied to an ink ejection head and is located in an inner bottom surface of an accommodation unit that is capable of accommodating an ink cartridge, an electrical connection portion, which is arranged on an inclined surface extending in a direction intersecting the inner bottom surface in the accommodation unit, an accommodation unit positioning portion, which is arranged between the inclined surface and the ink inlet in the accommodation unit, and a lever including a restriction portion capable of restricting movement of the ink cartridge when accommodated in the accommodation unit in a direction in which the ink cartridge is removed from the accommodation unit. When the terminal unit is mounted on the cartridge holder, a terminal group is configured and arranged to be in contact with the electrical connection portion, an engaging portion is configured and arranged to be engaged with the restriction portion of the lever, and a unit positioning portion is positioned by the accommodation unit positioning portion.

In this configuration, the terminal unit is mounted on the cartridge holder with the movement of the ink cartridge in the removal direction restricted by the engaging portion, and the unit positioning portion positioned by the accommodation unit positioning portion closer to the inclined surface than the ink inlet. Thus, the terminal group and the electrical connection portion can be connected with a compact structure in a satisfactory manner. By mounting the terminal unit on the cartridge holder, ink may be ejected from the ink ejection head even when ink is supplied from the ink supply unit, which does not include the terminal group corresponding to the electrical connection portion of the cartridge holder, to the ink ejection head through the ink inlet of the cartridge holder.

Preferably, in the terminal unit, the terminal group is arranged between the engaging portion and the unit positioning portion.

In this configuration, the terminal group is arranged between the engaging portion and the unit positioning portion. Thus, when the terminal unit is mounted on the cartridge holder, the engaging portion is engaged with and restrained by the restriction portion of the lever, and the unit positioning portion is positioned by the accommodation unit positioning portion. This allows the electrical connection portion and the terminal group to be accurately connected.

Preferably, in the terminal unit, the unit positioning portion is engaged with and restrained by the accommodation unit positioning portion.

In this configuration, when the terminal unit is mounted on the cartridge holder, the engaging portion is engaged with the restriction portion of the lever, and the unit positioning portion is engaged with and restrained by the accommodation unit positioning portion. This limits separation of the terminal unit from the cartridge holder.

Preferably, in the terminal unit, two or more ink inlets and two or more electrical connection portions are arranged in the same direction in the cartridge holder, and two or more terminal groups are arranged in the same direction as the direction the electrical connection portions are arranged in correspondence with the electrical connection portions.

In this configuration, the connection of two or more electrical connection portions and terminal groups is achieved by a single operation of mounting the terminal unit. This increases the mounting efficiency.

Preferably, in the terminal unit, the number of engaging portions is less than the number of terminal groups.

In this configuration, the locations where the engaging portions and the levers are engaged can be reduced compared to when the number of engaging portions is the same as the number of terminal groups. Therefore, when removing the terminal unit from the cartridge holder, the locations of the engaging portions and the restriction portions of the levers can be reduced.

Preferably, in the terminal unit, the number of unit positioning portions is less than the number of terminal groups.

In this configuration, the locations where the unit positioning portions and the accommodation unit positioning portions are positioned can be reduced compared to when the number of the unit positioning portions is the same as the number of the terminal groups.

Preferably, in the terminal unit, the unit positioning portion is arranged on two opposite sides of at least one of the terminal groups in the direction in which the terminal groups are arranged.

In this configuration, when mounting the terminal unit on the cartridge holder, at least the terminal group located between the unit positioning portions in the direction in which the terminal groups are arranged can be accurately connected to the electrical connection portion. When the unit positioning portions are located on two sides of two or more terminal groups in the direction in which the terminal groups are arranged, the number of positioning locations can be reduced.

Preferably, in the terminal unit, an interruption unit interrupts connection of at least some terminals of the terminal group and the electrical connection portion based on an external operation.

In this configuration, the connection of at least some terminals of the terminal group and the electrical connection portion can be easily interrupted by simply operating the interruption unit. Thus, the liquid ejection device can recognize when the terminal unit is removed from the cartridge holder. This allows, for example, head cleaning and the like, which would be performed during replacement of the ink cartridge when the ink cartridge is removed and attached, to be performed.

In the terminal unit, the unit positioning portion is configured and arranged to be engaged with the accommodation unit positioning portion, which is a through hole formed in the inner bottom surface of the accommodation unit.

In this configuration, the accommodation unit positioning portion can be easily formed. Furthermore, the engagement of the unit positioning portion and the accommodation unit positioning portion allows for satisfactory connection of the terminal group and the electrical connection portion.

An ink supply unit that solves the above problem is mountable on a cartridge holder including an ink inlet, which draws in ink supplied to an ink ejection head and is located in an inner bottom surface of an accommodation unit that is capable of accommodating an ink cartridge, an accommodation unit restriction portion, which restricts movement of the ink cartridge in a removal direction and is arranged on a side surface intersecting the inner bottom surface in the accommodation unit, and an accommodation unit engagement portion, which is arranged so that the accommodation unit engagement portion and the accommodation unit restriction portion are located at opposite sides of the ink inlet in the inner bottom surface. The ink supply unit includes a unit first engagement portion engageable with the accommodation unit restriction portion, a unit second engagement portion engageable with the accommodation unit engagement portion, and an ink outlet located between the unit first engagement portion and the unit second engagement portion. The ink outlet is connectable to the ink inlet. An ink supply passage is in fluid communication with the ink outlet.

In this configuration, by mounting the ink supply unit on the cartridge holder, the ink can be supplied to the ink inlet without the need for mounting the ink cartridge. Furthermore, the ink supply unit includes the ink outlet arranged between the unit first engagement portion and the unit second engagement portion. Thus, when mounted on the cartridge holder, the unit first engagement portion and the accommodation unit restriction portion are engaged and the unit second engagement portion and the accommodation unit engagement portion are engaged. This ensures connection of the ink outlet and the ink inlet on the cartridge holder and smoothly supplies ink to the ink inlet.

Preferably, the ink supply unit further includes a connection portion connectable to a tube that supplies the ink supply passage with ink from outside the accommodation unit.

In this configuration, ink can be supplied from outside the accommodation unit to the ink supply passage through the tube by connecting the tube to the connection portion. This allows ink to be supplied from an ink reservoir having a larger capacity than the ink cartridge.

Preferably, in the ink supply unit, the connection portion is configured by a hollow ink supply needle.

In this configuration, in addition to the tube, a cartridge adapter including an ink outlet port sealed with a seal member formed by a film, rubber, or the like may also be connected to the connection portion.

Preferably, the ink supply unit includes a filter that comes into planar contact with the ink inlet when the ink supply unit is mounted on the cartridge holder, and a porous member and a biasing member, which biases the porous member toward the ink inlet, arranged at an inner side of the filter.

In this configuration, the biasing member biases the filter toward the ink inlet through the porous member. Thus, the filter can be stably pushed against the ink inlet, and the ink can be smoothly supplied from the ink outlet of the ink supply unit to the ink inlet of the cartridge holder.

Preferably, the ink supply unit includes a filter that comes into planar contact with the ink inlet when the ink supply unit is mounted on the cartridge holder, and an elastic porous member arranged at an inner side of the filter.

In this configuration, the filter is biased toward the ink inlet side by the elasticity of the porous member. Thus, the filter can be stably pushed against the ink inlet, and the ink can be smoothly supplied from the ink outlet of the ink supply unit to the ink inlet of the cartridge holder.

Preferably, the ink supply unit further includes an air discharge passage that discharges air out of the ink supply passage.

In this configuration, air is drawn out of the ink supply passage through the air discharge passage to eliminate air from the ink supply passage.

An adapter that solves the above problem is mountable on a cartridge holder including an ink inlet that draws in ink supplied to an ink ejection head and is arranged on an inner bottom surface of an accommodation unit capable of accommodating an ink cartridge, an electrical connection portion arranged on an inclined surface extending in a direction intersecting the inner bottom surface in the accommodation unit, an accommodation unit restriction portion that restricts movement of the ink cartridge in a removal direction and is arranged on a side surface intersecting the inner bottom surface in the accommodation unit, and a lever including a restriction portion capable of restricting movement of the ink cartridge when accommodated in the accommodation unit in a direction in which the ink cartridge is removed from the accommodation unit. When the adapter is mounted on the cartridge holder, an ink outlet is connected to the ink inlet, a terminal group contacts the electrical connection portion, an engaging portion is engaged with the restriction portion of the lever, and a unit first engagement portion is engaged with the accommodation unit restriction portion. The ink outlet and the terminal group are arranged between the engaging portion and the unit first engagement portion.

In this configuration, the ink outlet and the terminal group are arranged between the engaging portion and the unit first engagement portion. Thus, when the adapter is mounted on the cartridge holder, the engaging portion is engaged with the restriction portion of the lever, and the unit first engagement portion is engaged with the accommodation unit restriction portion. Thus, the connection of the ink inlet and the ink outlet and the connection of the electrical connection portion and the terminal group are performed in a satisfactory manner.

DESCRIPTION OF EXEMPLARY EMBODIMENTS

One embodiment of a multifunction machine will now be described with reference to the drawings.

Figure 1:
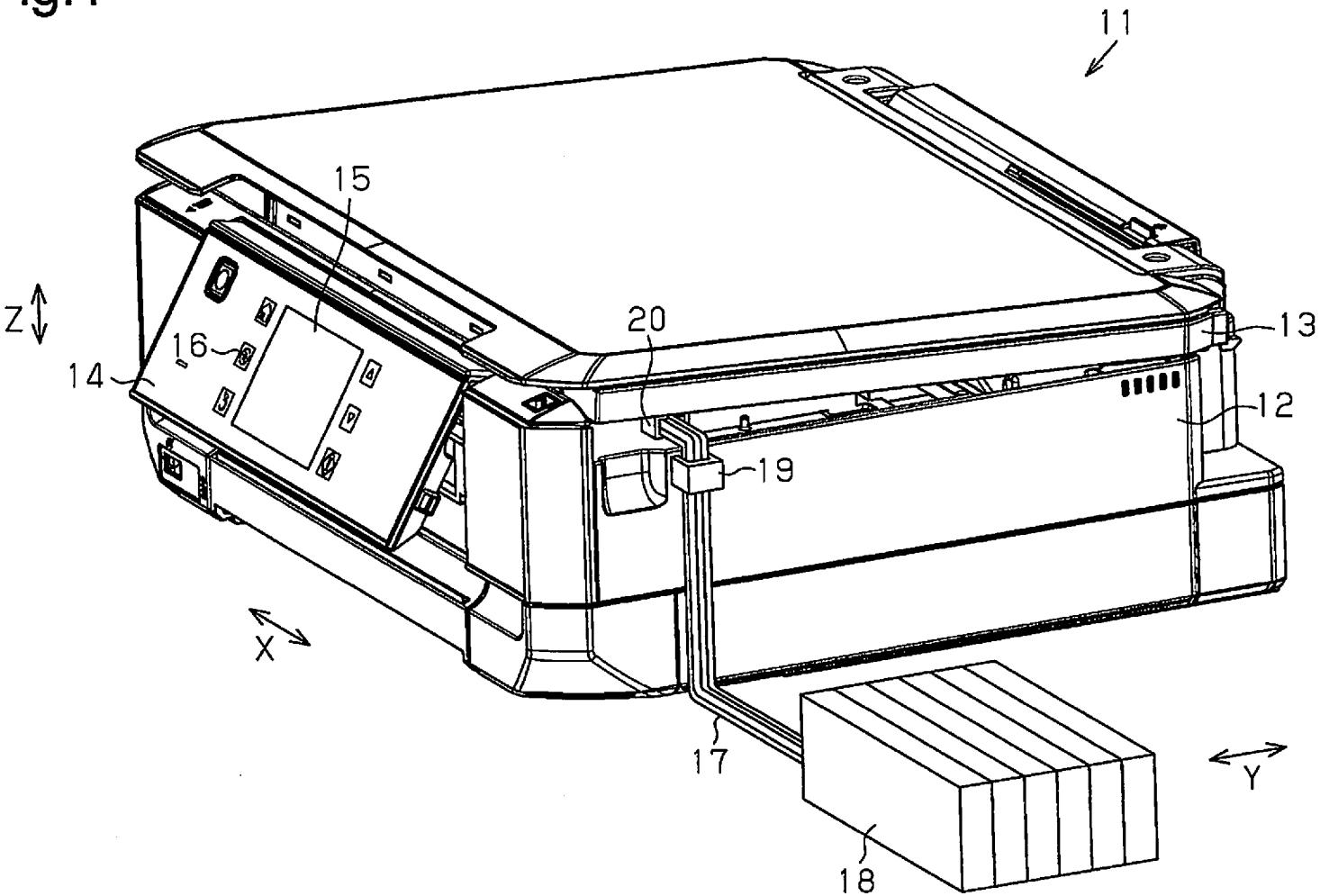
FIG. 1 is a perspective view showing one embodiment of a multifunction machine.

As shown in FIG. 1, a multifunction machine 11 is substantially box-shaped as a whole and includes an inkjet printer 12, which is one type of a liquid ejection device, and a scanner unit 13 arranged on the printer 12 and can be freely opened and closed. In the description hereafter, the two directions of the gravitational direction (downward direction) and the anti-gravitational direction (upward direction) define a vertical direction Z, a width-wise direction of the multifunction machine 11 orthogonal to the vertical direction Z is referred to as a lateral direction X, and a depth-wise direction of the multifunction machine 11 orthogonal to both of the vertical direction Z and the lateral direction X is referred to as a front-rear direction Y.

A pivot type operation panel unit 14 is arranged on a front side of the printer 12. A liquid crystal display 15, which shows a menu screen and the like, and operation buttons 16 used to perform various types of operations, are arranged on the front side of the operation panel unit 14. An ink tank 18, which is a large capacity ink reservoir, arranged on an outer side of the printer 12 can be connected to the printer 12 by tubes 17 for supplying ink. Therefore, the ink contained in the ink tank 18 can be supplied to the printer 12 through the tubes 17.

Figure 2:
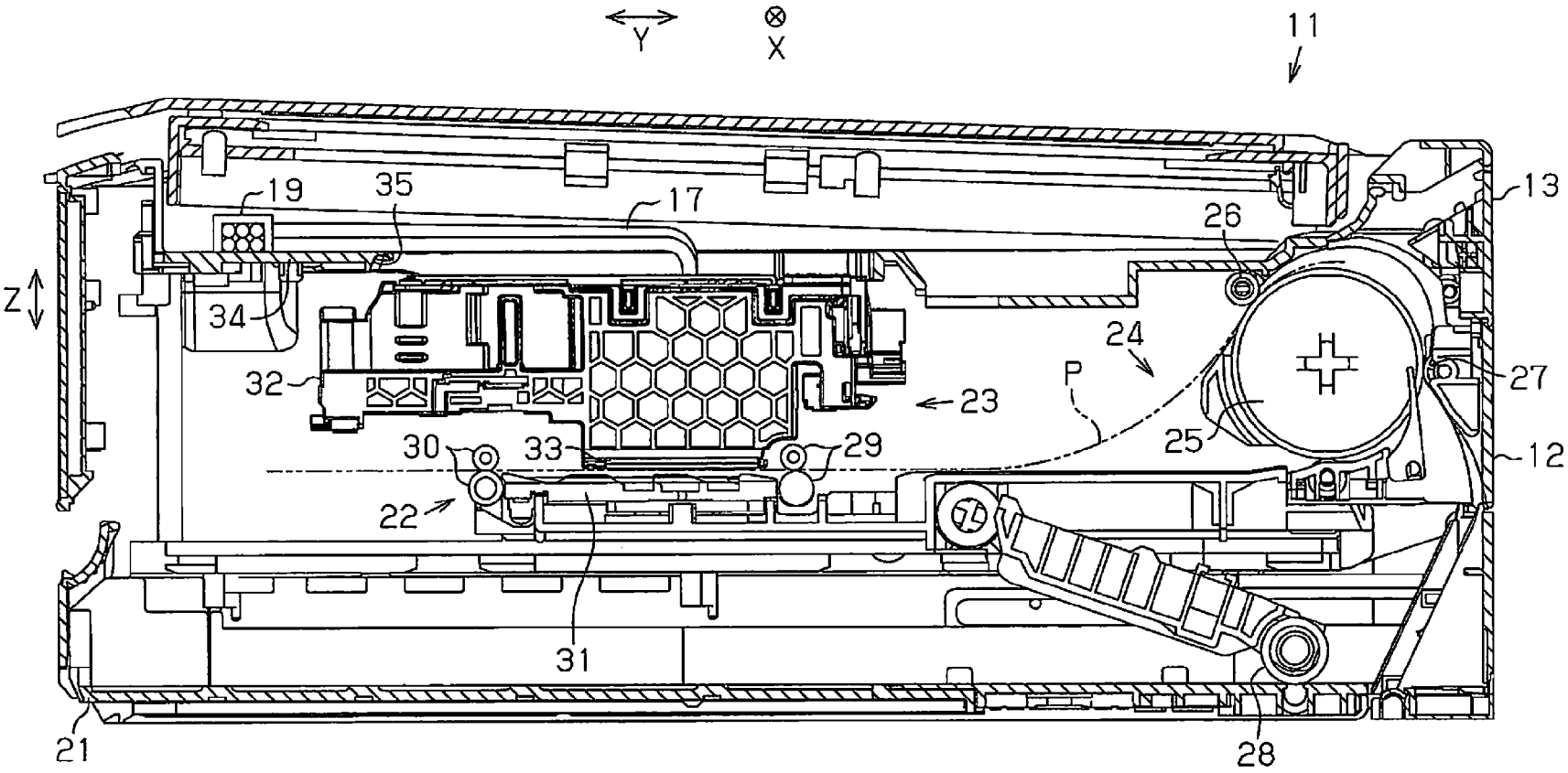
FIG. 2 is a cross-sectional view of FIG. 1.

As shown in FIG. 2, a paper cassette 21 that can store stacked sheets of paper P, which is a type of a recording medium, is coupled in a removable manner to a bottom portion of the printer 12. The upper side of the paper cassette 21 includes a conveying mechanism 22, which conveys paper P along a conveying path, and a recording unit 23, which performs printing on the paper P conveyed by the conveying mechanism 22.

The conveying mechanism 22 includes a feed mechanism 24 that feeds the recording unit 23 with paper P one at a time from the paper cassette 21. The feed mechanism 24 includes a feed driving roller 25, a feed driven roller 26 driven and rotated while holding a sheet of paper P with the feed driving roller 25, a separation roller 27, and a pickup roller 28.

Furthermore, the conveying mechanism 22 includes a paper feed roller pair 29, which feeds the paper P fed from the feed mechanism 24 toward the recording unit 23, and a paper discharge roller pair 30, which discharges the paper P that has undergone printing in the recording unit 23. A support board 31 that supports the paper P, which has undergone printing in the recording unit 23, is arranged between the paper feed roller pair 29 and the paper discharge roller pair 30 in the conveying path of the paper P.

A carriage 32 configuring the recording unit 23 is supported to reciprocate along a main scanning direction X (lateral direction X) above the support board 31 in the printer 12. An ink ejection head 33, which can eject ink onto the paper P supported by the support board 31, is supported by the lower part of the carriage 32. Printing is performed on the paper P by ejecting ink from the ink ejection head 33 onto the paper P conveyed on the support board 31 by the conveying mechanism 22.

An upper wall 34 of the printer 12 includes an open portion 35 located above a region in which the carriage 32 is moved in the main scanning direction X (lateral direction X) of the carriage 32. The open portion 35 is shaped in conformance with the moving region. When the scanner unit 13 is open, the carriage 32 is exposed through the open portion 35 in the upper wall 34 of the printer 12.

Figure 3:
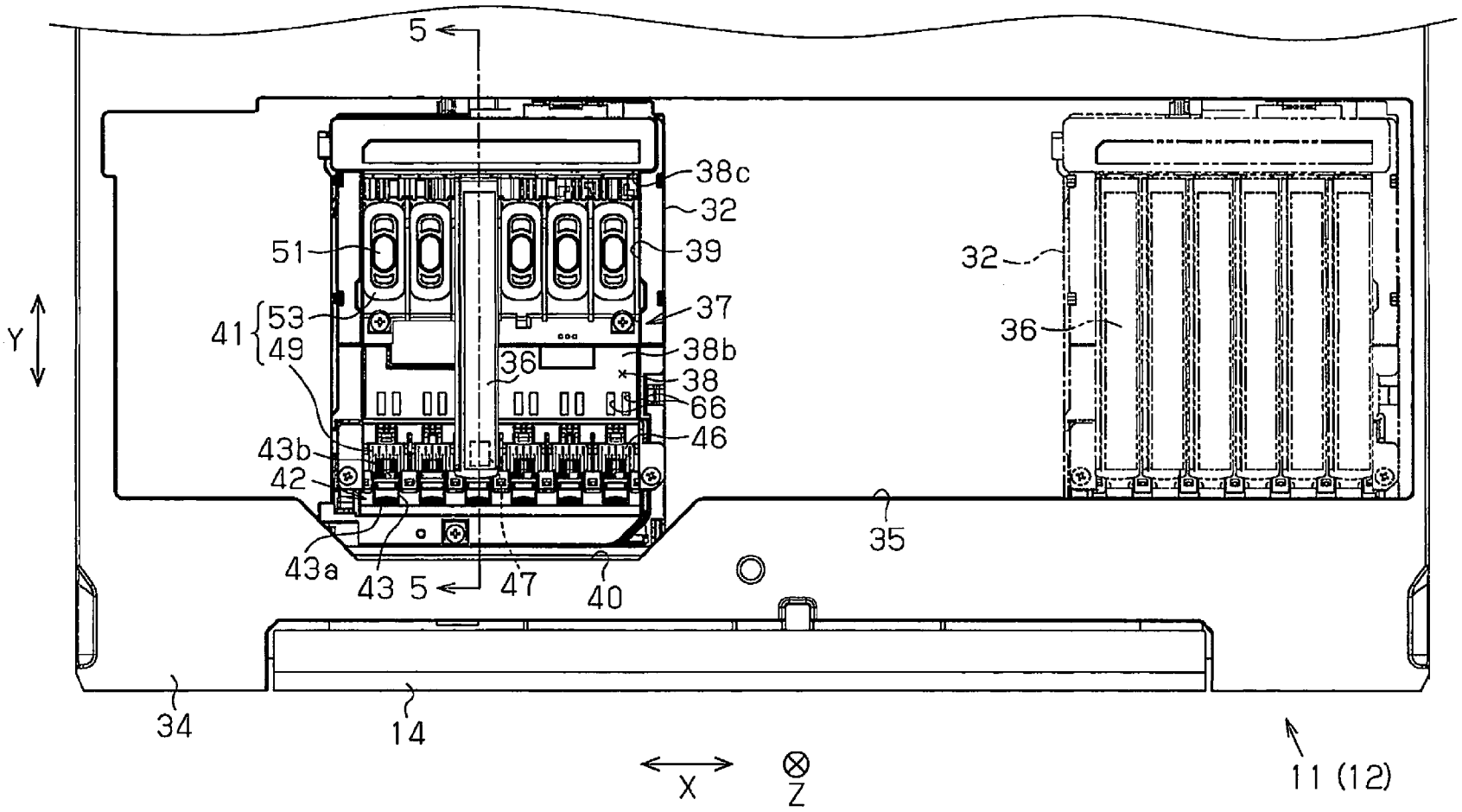
FIG. 3 is a plan view of a printer of the multifunction machine in which an ink cartridge is used.

As shown in FIG. 3, a cartridge holder 37, to which ink cartridges 36 containing ink can be coupled in a removable manner, is mounted on the upper portion of the carriage 32. The cartridge holder 37 includes an accommodation unit 38 capable of accommodating the ink cartridges 36. A plurality of (six in the present embodiment) ink cartridges 36 are accommodated in the accommodation unit 38 next to one another in the lateral direction X.

The accommodation unit 38 includes an open upper end that defines a mounting port 39. Thus, when the scanner unit 13 (see FIG. 2) is open, the upper surface side of the carriage 32 is exposed. This allows the ink cartridges 36 to be inserted into the accommodation unit 38, and the ink cartridges 36 may be removed from the accommodation unit 38 through the mounting port 39. Therefore, in the present embodiment, the upward direction defines a removal direction of the ink cartridges 36 from the accommodation unit 38.

The open portion 35 of the printer 12 extends in the lateral direction X. A cutout 40 is defined in front of the open portion 35 toward one side (toward left side in FIG. 3) in the lateral direction X. The position where the cutout 40 is formed is an attachment/detachment position where the carriage 32 is arranged when an ink cartridge 36 is attached to or detached from the cartridge holder 37.

The configuration of the cartridge holder 37 will now be described in detail.

As shown in FIG. 3, the cartridge holder 37 includes a biasing mechanism 41 and a holding mechanism 42. The biasing mechanism 41 biases the ink cartridges 36 of the accommodation unit 38 in the upward direction, which is the removal direction of the ink cartridges 36. The holding mechanism 42 holds the ink cartridges 36 accommodated in the accommodation unit 38 against the biasing force of the biasing mechanism 41.

The holding mechanism 42 includes a plurality of (six in the present embodiment) pivotal levers 43 arranged at equal intervals in the lateral direction X. The levers 43 are located at the side of the mounting port 39 of the accommodation unit 38 in the vertical direction Z and arranged in front of the accommodation unit 38 in the front-rear direction Y.

The lever 43 includes an operating portion 43*a* and a restriction portion 43*b*. The operating portion 43*a*, which is located at the upper side of the pivot center, receives an external operation force. The restriction portion 43*b*, which engages the ink cartridge 36 and is located at the lower side of the pivot center, restricts movement of the ink cartridge 36 from the accommodation unit 38 in the upward direction (removal direction).

The cutout 40 of the open portion 35 exposes the operating portion 43*a*, which is arranged on the cartridge holder 37, to receive external operation force when located at the attachment/detachment position where the ink cartridge 36 is attached or detached. The operating portion 43*a* is hidden in the printer 12 when located at positions other than the attachment/detachment position.

Thus, the operating portion 43*a* of the lever 43 is exposed through the cutout 40 and is in an operable state when the carriage 32 is located at the attachment/detachment position (position indicated by solid lines in FIG. 3). The operating portion 43*a* of the lever 43 is hidden by the upper wall 34 of the printer 12 and is inoperable when the carriage 32 is located arranged at a position other than the attachment/detachment position (e.g., position indicated by double-dashed line in FIG. 3).

Figure 4:
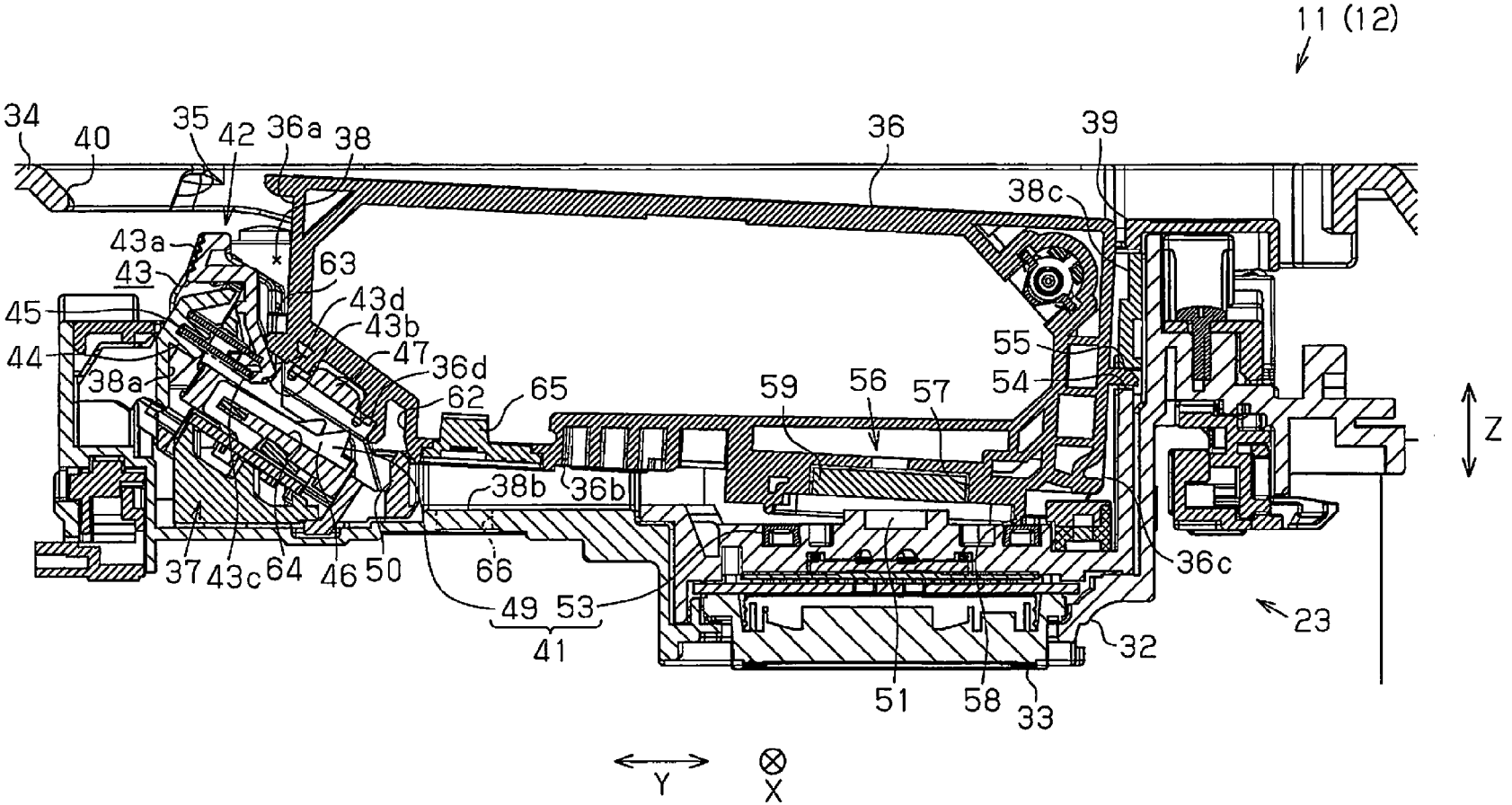
FIG. 4 is a cross-sectional view showing an ink cartridge mounted on a cartridge holder of the printer.

As shown in FIG. 4, the bottom part of the lever 43 includes the restriction portion 43*b* at the rear side (right side in FIG. 4) and a spring seat 43*c* at the front side (left side in FIG. 4). An inclined portion 43*d* inclined toward the rear from the side of the pivot center (upper side) toward the side of the restriction portion 43*b* (lower side) is formed on the rear surface of the lever 43.

The accommodation unit 38 includes a front wall 38*a*, which is an inner wall located at the front side. A spring hook 44 projects diagonally downward from the front wall 38*a* at a position located at the side of the mounting port 39 (upper side) in the vertical direction Z. A coil spring 45 that biases the bottom side of the lever 43 toward the rear side (right side in FIG. 4) is held between the spring hook 44 and the spring seat 43*c* of the lever 43.

In front of the inner bottom surface 38*b* in the accommodation unit 38, an inclined surface 64 extending in a direction intersecting the inner bottom surface 38*b* is formed adjacent to the inner bottom surface 38*b*. A plurality of electrical connection portions 46 (six in the present embodiment), respectively connectable to the circuit substrates 47 of the ink cartridges 36, are formed next to one another in the lateral direction X on the inclined surface 64. Predetermined information (e.g., identification data of ink cartridge 36, data of remaining amount of ink, etc.) is stored in the circuit substrate 47.

Each electrical connection portion 46 includes a movable contact portion 49 that projects into the accommodation unit 38. Each movable contact portion 49 is configured by an elastic metal member. Therefore, when the movable contact portion 49 contacts the circuit substrate 47 of the ink cartridge 36 accommodated in the accommodation unit 38, the movable contact portion 49 is elastically deformed in accordance with the contact pressure. Furthermore, each electrical connection portion 46 is electrically connected to a controller (not shown) of the multifunction machine 11.

The circuit substrate 47 is connected to the movable contact portion 49 of the electrical connection portion 46 so that the multifunction machine 11 reads the predetermined information of the circuit substrate 47. When the predetermined information of the ink cartridge 36 is read in such a manner, the printer 12 performs a printing operation, that is, the ink ejection head 33 ejects ink.

As shown in FIGS. 3 and 4, a restriction pin 50 projects upward from the inner bottom surface 38*b* of the accommodation unit 38 at the rear side of the electrical connection portion 46. A through hole 66, serving as an example of an accommodation unit positioning portion and an accommodation unit engagement portion, extends through the inner bottom surface 38*b* of the accommodation unit 38 in the proximity of the rear side of the restriction pin 50.

The through hole 66 is used to emit light from a light emitting unit (not shown), which is located below the carriage 32, to a prism 65 on a lower surface of the ink cartridge 36 and determine the presence of ink in the ink cartridge 36 from the amount of reflection light received by a light receiving unit (not shown). In the present embodiment, six sets of paired left and right through holes 66 are arranged next to one another in the lateral direction X in correspondence with the prisms 65 of the ink cartridges 36.

A plurality of (six in the present embodiment) ink inlets 51 are arranged next to one another in the lateral direction X (direction in which the electrical connection portion 46 are arranged next to one another) to draw in the ink supplied from the ink cartridge 36 to the ink ejection head 33 in the inner bottom surface 38*b* of the accommodation unit 38 near the rear end. Therefore, each through hole 66 is located between the inclined surface 64 and the ink inlet 51 in the inner bottom surface 38*b* of the accommodation unit 38. Each ink inlet 51 is covered by an accommodation unit filter 97 (see FIG. 14).

A seal member 53 is arranged at the periphery of each ink inlet 51 to surround the ink inlet 51. The seal member 53 is an elastic member of synthetic rubber or the like and limits the leakage and vaporization of ink when the ink cartridge 36 and the ink inlet 51 are connected.

In the accommodation unit 38, a central part in the vertical direction Z of a rear wall 38*c*, which is the inner wall located at the rear side, includes a recess 54, serving as an example of an accommodation unit restriction portion. In other words, the recess 54 is arranged in a side surface (inner surface of rear wall 38*c*) intersecting the inner bottom surface 38*b* in the accommodation unit 38. A plurality of (six in the present embodiment) the recesses 54 are arranged next to one another in the lateral direction X facing the ink cartridges 36.

The configuration of the ink cartridge 36 will now be described in detail.

As shown in FIG. 4, the ink cartridge 36 is substantially box-shaped, and the direction that lies along the front-rear direction Y when mounted on the cartridge holder is the longitudinal direction. When accommodated in the accommodation unit 38, the ink cartridge 36 includes a front surface 36*a* facing the front wall 38*a*, a bottom surface 36*b* facing the inner bottom surface 38*b*, and a rear surface 36*c* facing the rear wall 38*c*. A slope 36*d* is formed between the front surface 36*a* and the bottom surface 36*b* of the ink cartridge 36.

A projection 55, which is engageable with the recess 54, projects from the rear surface 36*c* of the ink cartridge 36. The bottom surface 36*b* of the ink cartridge 36 includes an ink supplying portion 56 near the rear end.

The ink supplying portion 56 includes an ink supplying hole 57, which is used to discharge ink from the ink cartridge 36, and an annular protrusion 58, which is formed to surround the periphery of the ink supplying hole 57. A drawing member 59 formed by a foam of synthetic resin or the like is arranged in the ink supplying hole 57.

When the ink cartridge is accommodated in the accommodation unit 38, the annular protrusion 58 first contacts the seal member 53 of the ink inlet 51. Then, the drawing member 59 in the ink supplying hole 57 contacts the ink inlet 51 and draws ink from the ink cartridge 36 into the ink inlet 51.

When the ink supplying hole 57 of the ink cartridge 36 is connected to the ink inlet 51 of the cartridge holder 37, the reaction force produced by the elastic deformation of the seal member 53 acts as an upward biasing force applied to the ink cartridge 36. Therefore, the movable contact portion 49 of the electrical connection portion 46 and the seal member 53 configure the biasing mechanism 41 that biases the ink cartridge 36 toward the upward direction, which is the removal direction, in the accommodation unit 38.

The circuit substrate 47 is attached to the slope 36*d* of the ink cartridge 36. A positioning hole 62, into which the restriction pin 50 can be inserted, is formed at a position in the slope 36*d* closer to the bottom surface 36*b* than the circuit substrate 47. The slope 36*d* includes an engagement protrusion 63 projecting toward the front side, which is the side of the lever 43, from a position closer to the front surface 36*a* than the circuit substrate 47.

A method for attaching and detaching the ink cartridge 36 to and from the cartridge holder 37 will now be described.

As shown in FIG. 3, when mounting the ink cartridge 36 on the cartridge holder 37, the carriage 32 is first arranged at the attachment/detachment position. This exposes the operating portion 43*a* of each lever 43 arranged on the cartridge holder 37 through the cutout 40 of the open portion 35. In this case, if the ink cartridge 36 is not mounted on the cartridge holder 37, the biasing force of the coil spring 45 projects the bottom side of the lever 43 toward the rear side.

As shown in FIG. 4, when the ink cartridge 36 is inserted into the accommodation unit 38 thereby engaging the projection 55 on the rear surface 36*c* of the ink cartridge 36 with the recess 54, the front side of the ink cartridge is pivoted by its weight about the projection 55. Consequently, the engagement protrusion 63 contacts the inclined portion 43*d* of the lever 43. At this point, the ink cartridge 36 is arranged at a removal position (position shown in FIG. 4) where the front upper part is exposed from the mounting port 39.

Then, when the front upper part of the ink cartridge 36 at the removal position is pushed toward the lower side, the engagement protrusion 63 of the ink cartridge 36 slides down and pushes the slope 36*d* of the lever 43 toward the front side. This pivots the lever 43 in the clockwise direction as viewed in FIG. 4 so that the bottom part of the lever 43 moves toward the front side against the biasing force of the coil spring 45.

Here, the ink cartridge 36 receives a biasing force serving as a reaction force from the movable contact portion 49 that elastically deforms when the circuit substrate 47 contacts the movable contact portion 49 of the electrical connection portion 46. In addition, the ink cartridge 36 receives the biasing force serving as the reaction force from the seal member 53 that elastically deforms in a course of connecting the ink supplying hole 57 to the ink inlet 51. When the restriction pin 50 is inserted into the positioning hole 62 of the ink cartridge 36, the movement of the ink cartridge 36 in the lateral direction X is restricted in the accommodation unit 38.

Figure 5:
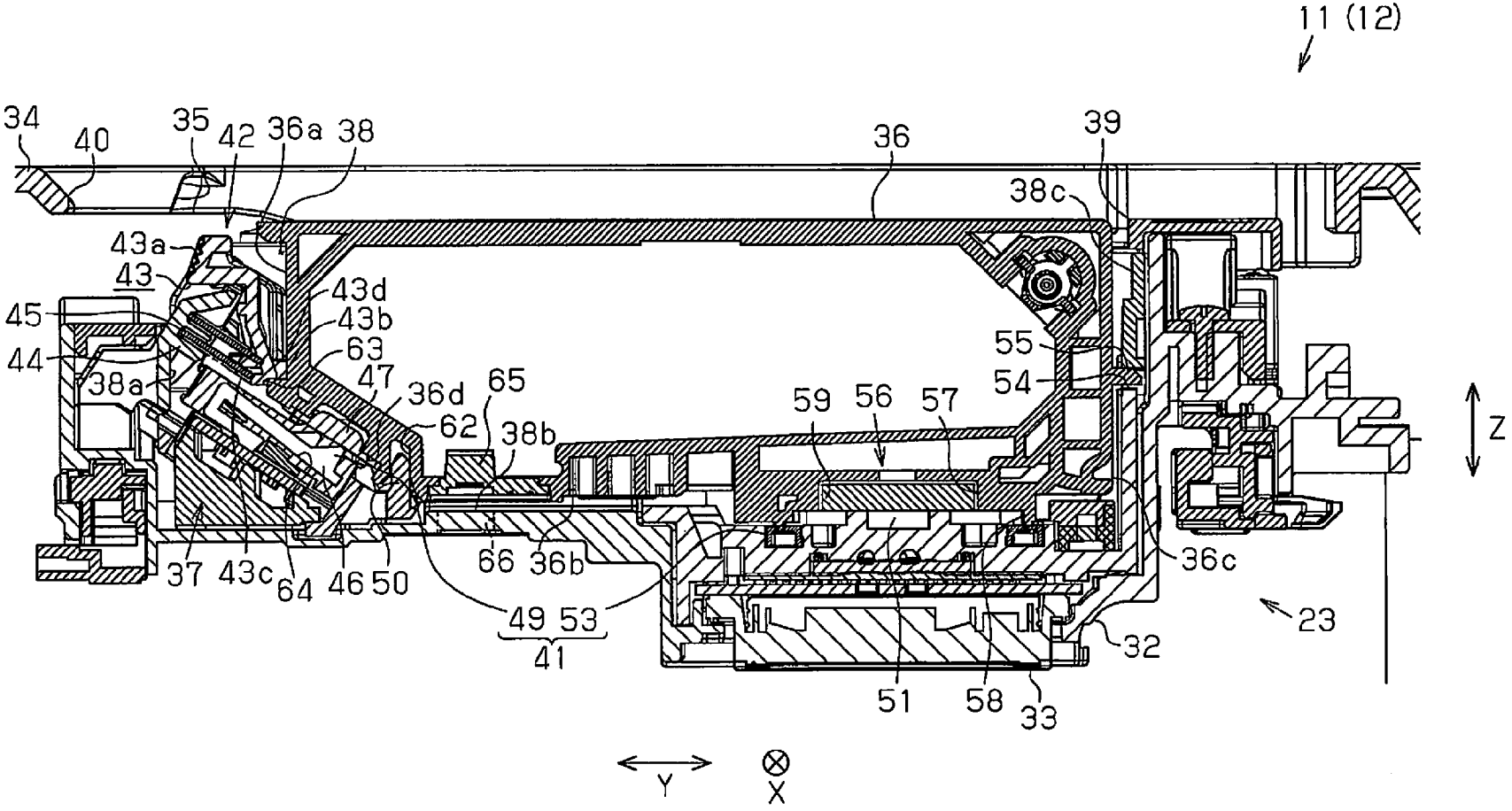
FIG. 5 is a cross-sectional view taken along line 5-5 in FIG. 3.

The ink cartridge 36 is further pushed into the accommodation unit 38 against the biasing force of the coil spring 45, the movable contact portion 49, and the seal member 53. This moves the engagement protrusion 63 of the ink cartridge 36 toward the lower side of the lever 43. This returns the lever 43 to its original position with the biasing force of the coil spring 45. Further, as shown in FIG. 5, the restriction portion 43*b* of the lever 43 restricts upward movement of the engagement protrusion 63 of the ink cartridge 36 against the biasing force of the biasing mechanism 41.

In this manner, the holding mechanism 42 (restriction portion 43*b*) restricts the movement of the ink cartridge 36 in the removal direction (upward direction) from the accommodation unit 38 against the biasing force of the biasing mechanism 41 when the ink cartridge 36 is accommodated in the accommodation unit 38.

When the ink cartridge 36 is accommodated in the accommodation unit 38 and the ink supplying portion 56 is connected to the ink inlet 51 as described above, the mounting of the ink cartridge 36 on the cartridge holder 37 is completed. Thus, the ink contained in the ink cartridge 36 can be supplied to the ink ejection head 33 through the ink inlet 51 to eject the ink from the ink ejection head 33.

Figure 6:
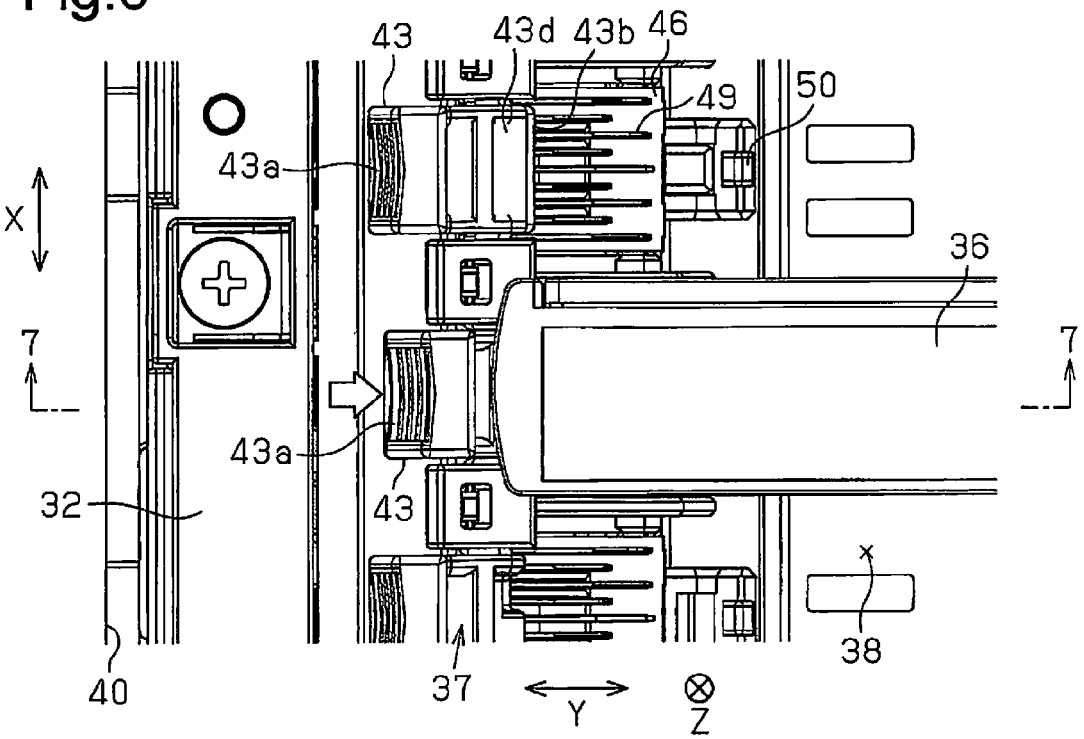
FIG. 6 is an enlarged plan view of a main portion shown in FIG. 5.

When removing the ink cartridge 36, which is mounted on the cartridge holder 37, from the accommodation unit 38, the carriage 32 is first moved to the attachment/detachment position to expose the operating portion 43*a* of the lever 43 in the same manner as when mounting the ink cartridge 36. Then, the operating portion 43*a* of the lever 43 is pushed toward the rear side as indicated by the arrow in FIG. 6.

Figure 7:
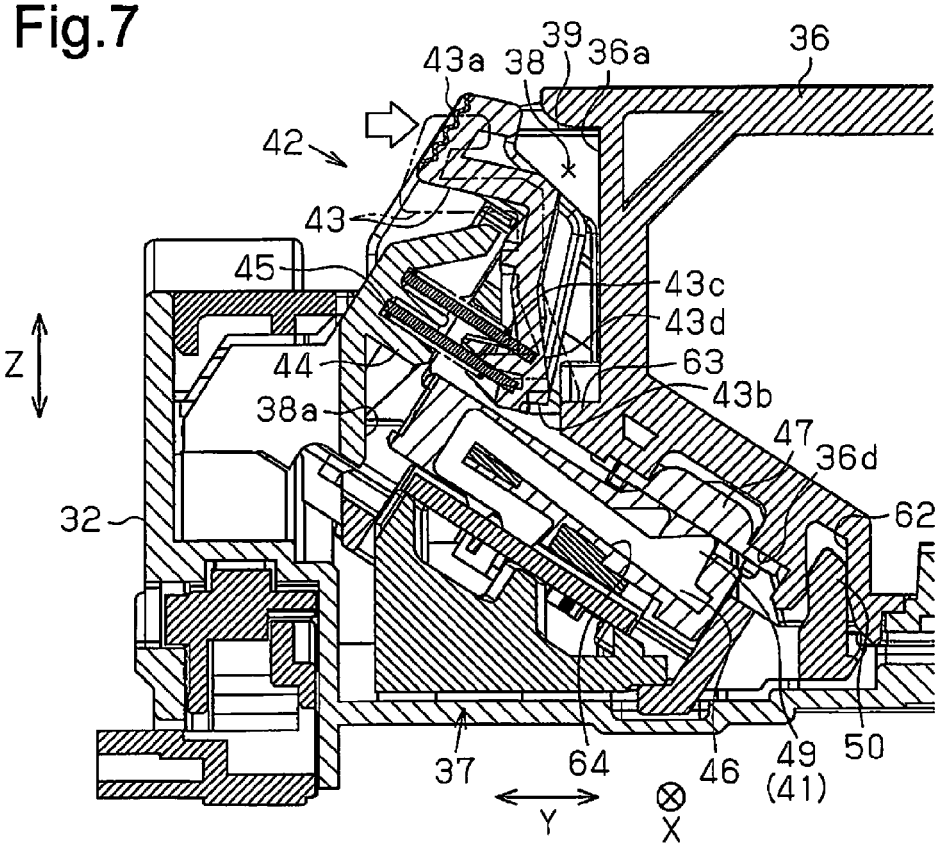
FIG. 7 is a cross-sectional view taken along line 7-7 in FIG. 6.

Then, as shown in FIG. 7, the lever 43 is pivoted in the clockwise direction from a restriction position as indicated by the double-dashed line toward a release position indicated by the solid line. This separates the restriction portion 43*b* from the engagement protrusion 63 of the ink cartridge 36. In other words, the holding mechanism 42 allows the ink cartridge 36 to move in the removal direction (upward direction) from the accommodation unit 38 when operation force is externally applied to the operating portion 43*a*. In FIG. 7, the upper wall 34 is omitted to clearly show the structure of the carriage 32.

When the restriction portion 43*b* is separated from the engagement protrusion 63 thereby disengaging the restriction portion 43*b* from the engagement protrusion 63, the biasing force of the biasing mechanism 41 moves the ink cartridge 36 in the upward direction, which is the removal direction.

In this case, when the restriction portion 43*b* is disengaged from the engagement protrusion 63 against the biasing force applied to the ink cartridge 36, the biasing mechanism 41 produces a biasing force that moves the ink cartridge 36 to the removal position where the ink cartridge is partially exposed toward the upper side from the mounting port 39. Thus, the ink cartridge 36 is popped up and lifted by the biasing force of the biasing mechanism 41.

When external operation force is no longer applied to the lever 43, the biasing force of the coil spring 45 pivots and moves the lever 43 in the counterclockwise direction as viewed in FIG. 7 from the release position to the restriction position. Thus, the ink cartridge 36, which has been moved to the removal position by the biasing force of the biasing mechanism 41, is supported by the slope 36*d* of the lever 43 at the engagement protrusion 63. Thus, the ink cartridge 36 is held at the removal position where the upper part is partially exposed toward the upper side from the mounting port 39, as shown in FIG. 4.

Next, the configuration of the printer 12 when drawing ink from the ink tank 18 through the ink inlet 51 instead of drawing ink from the ink cartridge 36 will be described.

Figure 8:
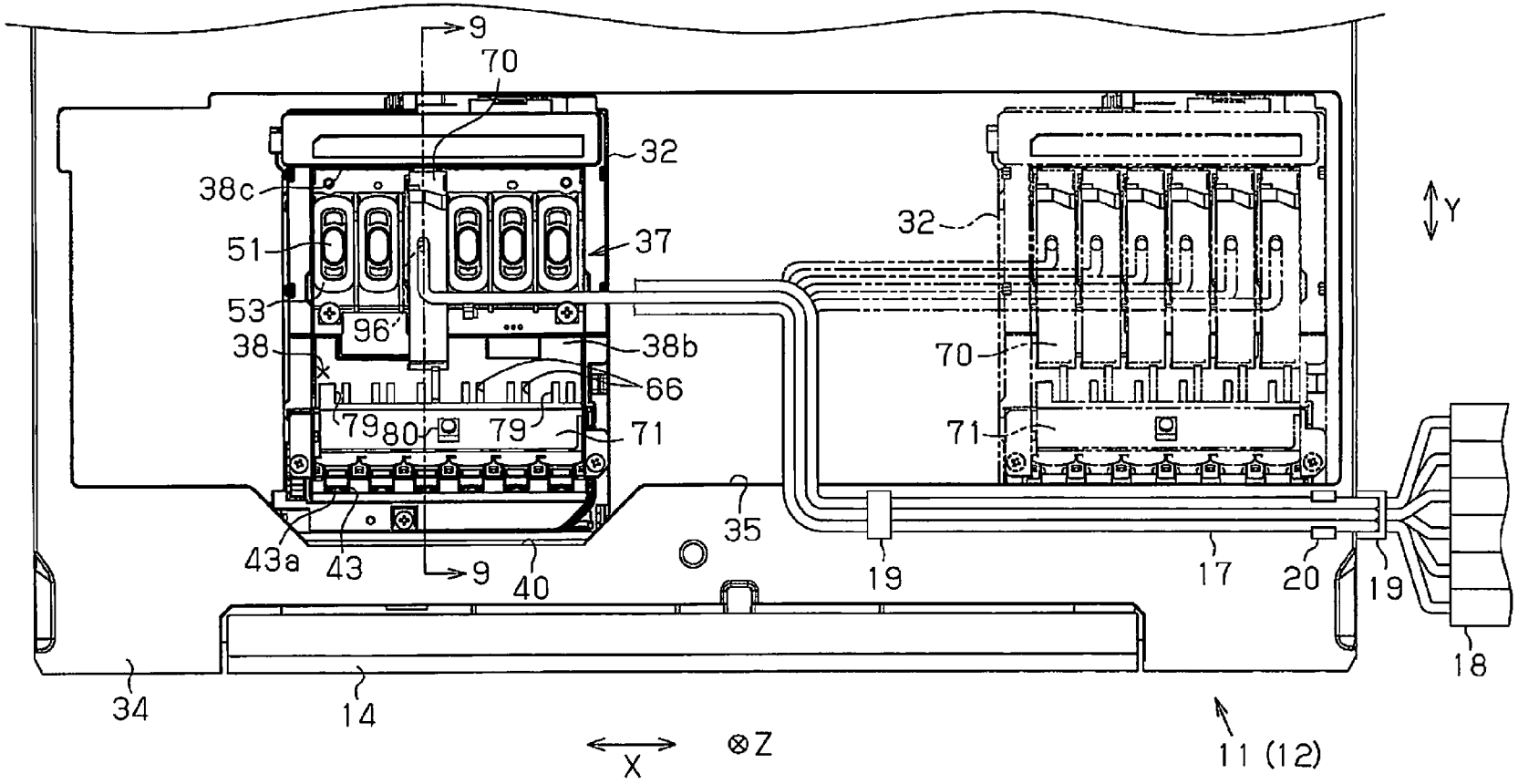
FIG. 8 is a plan view of the printer of the multifunction machine when an ink tank is used in place of the ink cartridge.

As shown in FIG. 8, ink is drawn from the ink tank 18 into the ink inlet 51 of the carriage 32 in the following manner. Instead of the ink cartridge 36, an ink supply unit 70 is mounted on the cartridge holder 37 in correspondence with each ink inlet 51. A single terminal unit 71 is mounted on the cartridge holder 37 in correspondence with every one of the electrical connection portions 46.

Figure 9:
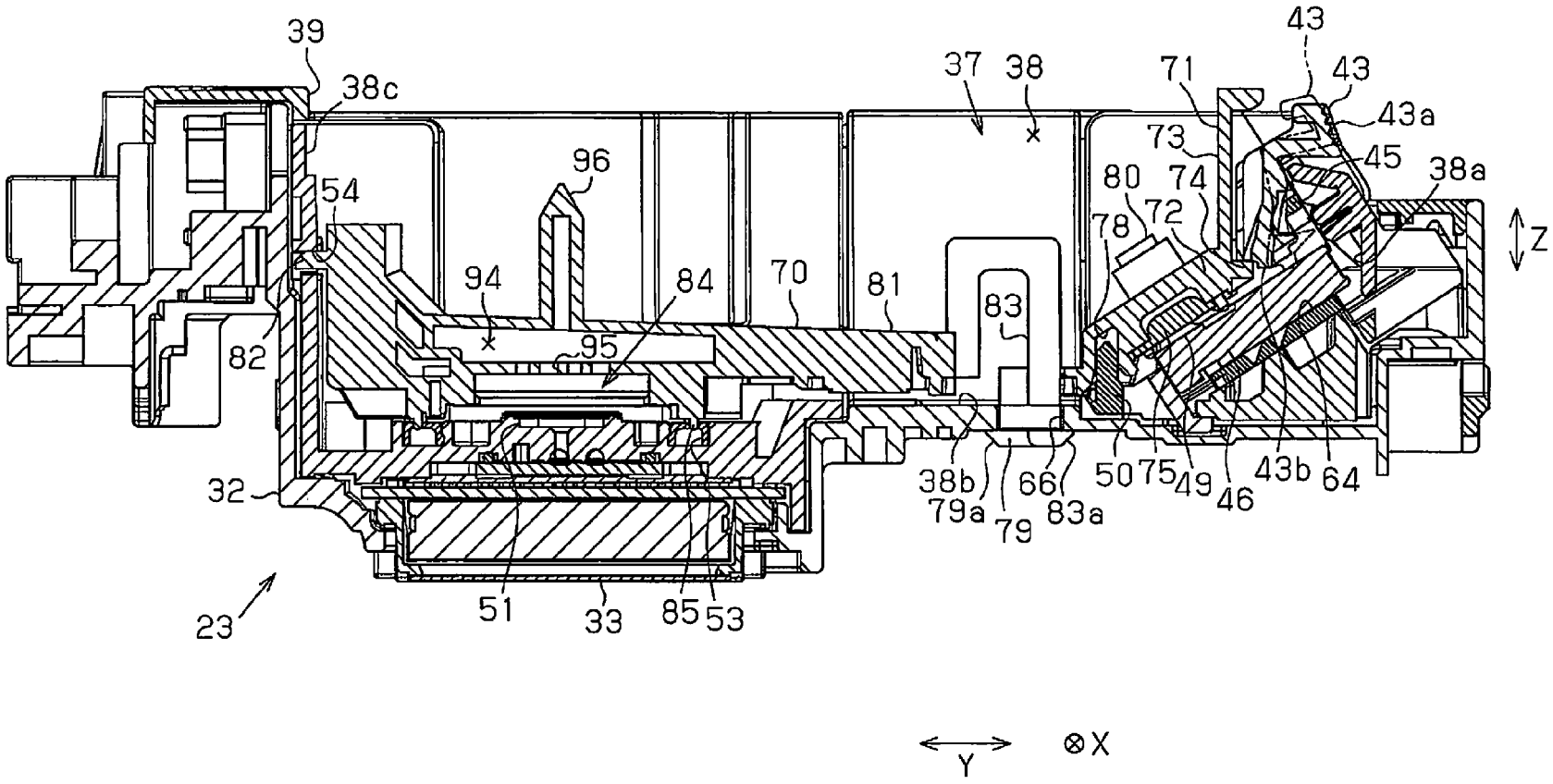
FIG. 9 is a cross-sectional view taken along line 9-9 in FIG. 8.
Figure 13:
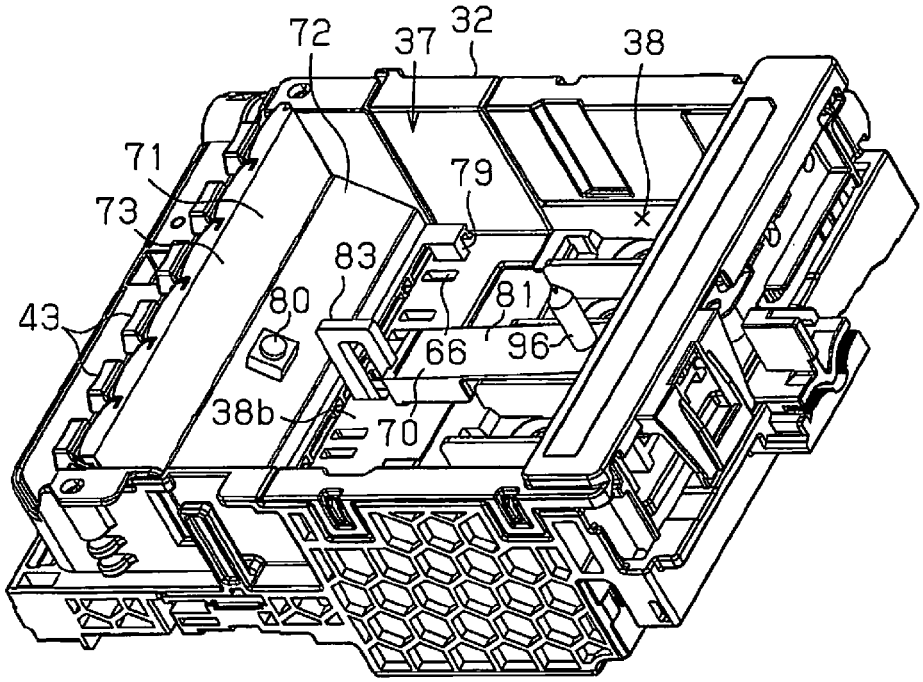
FIG. 13 is a perspective view taken from a rear side of the carriage of FIG. 12.

As shown in FIGS. 9 and 13, the terminal unit 71 includes a portion shaped similar to a region corresponding to the six ink cartridges 36 extending from the front surface 36*a* to the slope 36*d* (see FIG. 4). More specifically, the terminal unit 71 includes a unit slope 72, which has the shape of a rectangular plate in correspondence with the inclined surface 64 in the accommodation unit 38, and a vertical portion 73, which has the shape of a rectangular plate and extends straight toward the upper side from the upper end of the unit slope 72.

Figure 10:
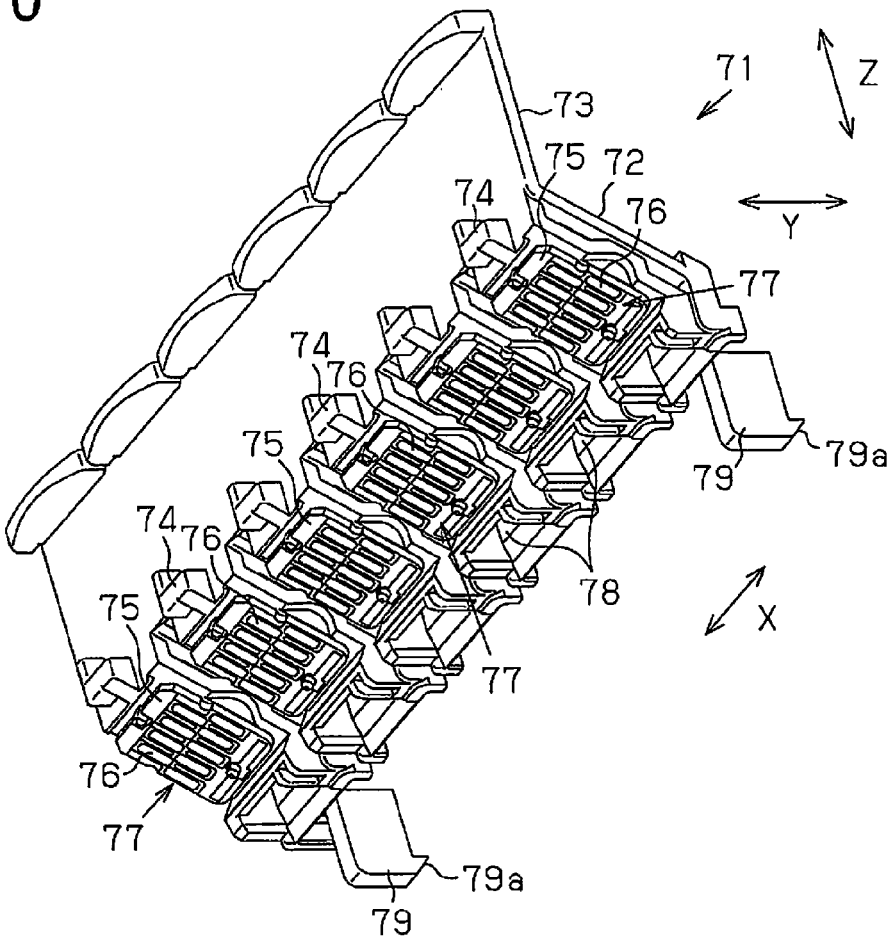
FIG. 10 is a perspective view of a terminal unit.

As shown in FIGS. 9 and 10, a plurality of (six in the present embodiment) engaging portions 74 project from the bottom part of the surface at the side of the front wall 38*a* of the accommodation unit 38 in the vertical portion 73. The engaging portions 74 are arranged next to one another at equal intervals in the lateral direction X and are respectively engaged with the restriction portions 43*b* of the levers 43 when the terminal unit 71 is mounted on the cartridge holder 37. Each engaging portion 74 has a shape that is substantially similar as the engagement protrusion 63 of the ink cartridge 36 (see FIG. 4).

A plurality of (six in the present embodiment) terminal members 75 are attached to the surface of the unit slope 72 in the accommodation unit 38 at the side of the inclined surface 64. The terminal members 75 are arranged next to one another in the lateral direction and respectively connected to the electrical connection portions 46 when the terminal unit 71 is mounted on the cartridge holder 37. In other words, the terminal members 75 are arranged next to one another at equal intervals in the lateral direction X, which is the same as the direction in which the electrical connection portions 46 are arranged, to respectively correspond to the electrical connection portions 46. Each terminal member 75 has the same configuration as the circuit substrate 47 of the ink cartridge 36 (see FIG. 4).

Each terminal member 75 includes a terminal group 77 including a plurality of (nine in the present embodiment) terminals 76, each contacting the movable contact portion 49. An insertion recess 78, into which the restriction pin 50 is inserted, is formed on the rear side of each terminal member 75 in the unit slope 72. Two unit positioning portions 79 are respectively arranged at the two sides of the unit slope 72 in the lateral direction X at the distal end.

Therefore, each terminal member 75 is arranged between the engaging portion 74 and the unit positioning portion 79 in the front-rear direction Y. Furthermore, in this case, two unit positioning portions 79 are arranged at the two sides, with four inner ones of the six terminal members 75 located between the unit positioning portions 79 in the lateral direction X, which is the direction the terminal members 75 (each terminal group 77) are arranged.

Furthermore, in the terminal unit 71 of the present embodiment, the number of unit positioning portions 79 is two and the number of terminal members 75 is six. Thus, the number of unit positioning portions 79 is less than the number of terminal members 75. In other words, in the terminal unit 71, the number of unit positioning portions 79 is less than the number of terminal groups 77.

Each unit positioning portion 79 has the shape of a substantially rectangular plate and is extended toward the lower side from the distal end of the unit slope 72. A latch hook 79*a* that projects toward the rear side is arranged at the bottom part of the rear surface of each unit positioning portion 79.

When the terminal unit 71 is mounted on the cartridge holder 37, the unit positioning portions 79 are inserted into and positioned in the left one of through holes 66 in the pairs of through holes 66 located at the left and right ends, as shown in FIG. 8. In this case, the latch hook 79*a* of each unit positioning portion 79 is latched in the corresponding through hole 66. In other words, the unit positioning portion 79 engages the through hole 66 (accommodation unit positioning portion).

As shown in FIGS. 9 and 13, a surface of the unit slope 72 in the terminal unit 71 at the side opposite to each terminal member 75 includes a reset button 80 serving as an example of an interruption unit that can electrically interrupt the connection of some terminals 76 of the terminal group 77 in each terminal member 75 and the movable contact portion 49 of each electrical connection portion 46. The reset button 80 is arranged at the central part of the unit slope 72.

When the user performs an external operation, or pushes the reset button 80, the connection of some of the terminals 76 in the terminal group 77 of each terminal member 75 and the movable contact portion 49 of each electrical connection portion 46 is electrically interrupted. Thus, the multifunction machine 11 (printer 12) acknowledges detachment of the terminal unit 71 from the cartridge holder 37. Furthermore, the pushing of the reset button 80 may function as a trigger for changing the communication data of the terminal unit 71 and the content of the memory.

When the user pushes the reset button 80 again during electrical interruption of the connection of some terminals 76 of the terminal group 77 of each terminal member 75 and the movable contact portion 49 of each electrical connection portion 46, some terminals 76 of the terminal group 77 of each terminal member 75 and the movable contact portion 49 of each electrical connection portion 46 are electrically connected.

Figure 11:
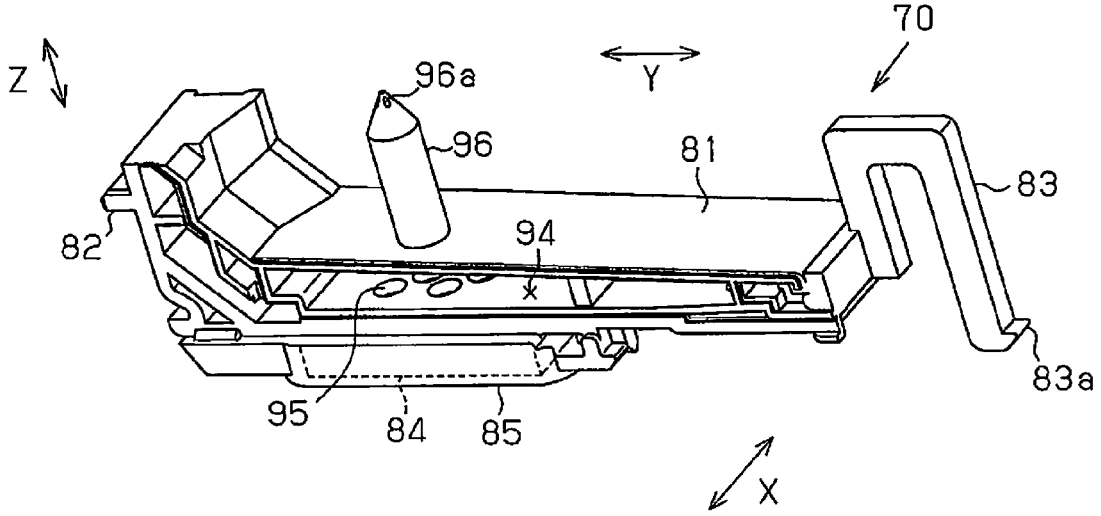
FIG. 11 is a perspective view of an ink supply unit.
Figure 12:
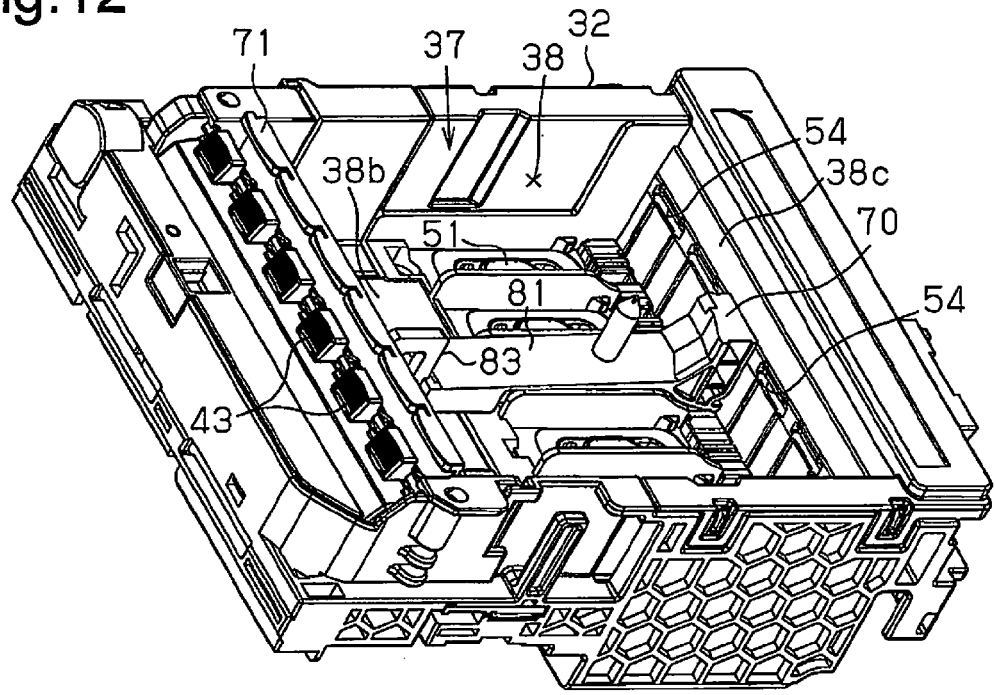
FIG. 12 is a perspective view taken from a front side of the carriage showing the ink supply unit and the terminal unit that are mounted on the cartridge holder.

As shown in FIGS. 9, 11, and 12, the ink supply unit 70 includes a portion having a shape substantially similar to the region from the bottom surface 36*b* to the rear surface 36*c* in a single ink cartridge 36 (see FIG. 4) as a whole. More specifically, the ink supply unit 70 includes a supplying unit main body 81 that is substantially block-shaped and elongated in the front-rear direction Y. A unit first engagement portion 82 that engages the recess 54 (accommodation unit restriction portion) when the ink supply unit 70 is mounted on the cartridge holder 37 projects from the rear surface of the supplying unit main body 81.

A unit second engagement portion 83 is arranged on the front surface of the supplying unit main body 81. The unit second engagement portion 83 is extended straight upward from the front surface of the supplying unit main body 81, bent at a right angle, extended straight, bent at a right angle, and then extended straight downward. A latch hook 83*a* projects toward the front from the distal end (bottom) of the unit second engagement portion 83. The openings in the two sides of the ink supply unit 70 in the lateral direction X are sealed by a sealing film (not shown).

When a plurality of (six in the present embodiment) ink supply units 70 are mounted on the cartridge holder 37, each unit second engagement portion 83 is inserted and positioned in the right one of the corresponding pair of through holes 66, as shown in FIG. 8. In this case, the latch hook 83*a* of each unit second engagement portion 83 is latched to each through hole 66. In other words, each unit second engagement portion 83 engages the through hole 66 (accommodation unit engagement portion).

Figure 14:
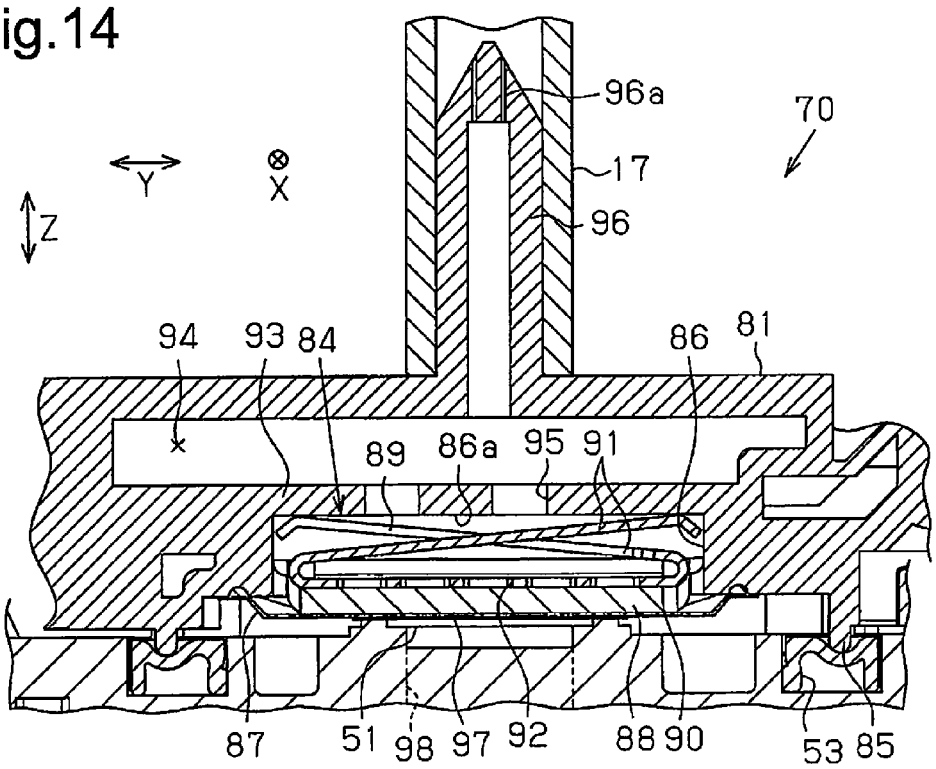
FIG. 14 is an enlarged cross-sectional view of a main portion shown in FIG. 9.

As shown in FIGS. 11 and 14, an ink outlet 84 connected to the ink inlet 51 when the ink supply unit 70 is mounted on the cartridge holder 37, and an annular protrusion 85 surrounding the periphery of the ink outlet 84 are arranged on the bottom portion of the supplying unit main body 81. Therefore, the ink outlet 84 is arranged between the unit first engagement portion 82 and the unit second engagement portion 83 in the front-rear direction Y.

As shown in FIG. 14, the ink outlet 84 includes a supply recess 86 having an open lower side (side of ink inlet 51), a unit filter 87 that covers the opening of the supply recess 86, a porous member 88 arranged at the inner side of the unit filter 87, and a spring member 89 serving as a biasing member arranged in the supply recess 86 to bias the porous member 88 toward the lower side. The porous member 88 includes many fine holes and is elastic.

The spring member 89 includes a flat plate-shaped pressure receiving portion 90 that contacts the porous member 88 and a plate spring portion 91 that contacts an inner bottom surface 86*a* of the supply recess 86. A plurality of holes 92 extend through the pressure receiving portion 90. An ink supply passage 94 is formed above the supply recess 86 in the ink supply unit 70. A partition wall 93 is located between the ink supply passage 94 and the supply recess 86. The partition wall 93 includes a plurality of communication holes 95 that communicate the ink supply passage 94 with the supply recess 86. Therefore, the ink supply passage 94 and the ink outlet 84 are in communication through the communication holes 95.

Furthermore, a hollow ink supply needle 96 is arranged on the upper side of the ink supply passage 94 in the ink supply unit 70. The ink supply needle 96 serves as an example of a connection portion, to which the tube 17 is connectable. The tube 17 supplies ink to the ink supply passage 94 from the ink tank 18 (see FIG. 1) arranged outside the printer 12 (see FIG. 1). The distal end of the ink supply needle 96 includes a needle communication hole 96*a* that communicates the inside with the outside of the ink supply needle 96.

When the ink supply unit 70 is mounted on the cartridge holder 37, the unit filter 87 of the ink outlet 84 comes into planar contact with the ink inlet 51 and connects the ink outlet 84 to the ink inlet 51. In this case, the ink inlet 51 is covered by the accommodation unit filter 97. Thus, the unit filter 87 and the accommodation unit filter 97 are in planar contact.

Here, when the plate spring portion 91 of the spring member 89 is compressed, the porous member 88 receives the biasing force of the spring member 89 and diffuses the ink supplied from the ink supply passage 94 in a planar form toward the unit filter 87. The diffused ink is passed through the unit filter 87 and the accommodation unit filter 97 and then supplied to the ink ejection head 33 (see FIG. 9) through a head supply passage 98.

The configuration connecting the tube 17 to the printer 12 will now be described.

As shown in FIGS. 1 and 8, a fixing member 19 fixes the tube 17 extending from the ink tank 18 to the side surface (right surface in FIG. 1) of the printer 12. A substantially C-shaped gap formation member 20 that forms a gap is arranged between the printer 12 and the scanner unit 13.

The tubes 17 are inserted through the gap formation member 20. The tubes 17 inserted through the gap formation member 20 on the upper surface of the upper wall 34 extend from the front side of the open portion 35 into the open portion 35 and then connected to the ink supply needle 96 of the ink supply unit 70. In this case, the tubes 17 are also fixed to the upper wall 34 by the fixing member 19. The number of the tubes 17 and the ink tanks 18 (six in the present embodiment) corresponds to the number of ink supply units 70.

The operation of the printer 12 of the multifunction machine 11 configured as described above will now be described focusing on when the printer 12 is supplied with ink from the ink tanks 18 to perform printing without using the ink cartridges 36.

As shown in FIG. 9, to have the printer 12 perform printing with the ink supplied from the ink tanks 18, six ink supply units 70 are first mounted on the cartridge holders 37 in place of the ink cartridges 36 so that the ink outlets 84 of the ink supply units 70 are arranged in correspondence with the ink inlets 51. In each ink supply unit 70, the unit first engagement portion 82 is engaged with the recess 54, and the unit second engagement portion 83 is engaged with the corresponding through hole 66. In this case, the latch hook 83*a* of the unit second engagement portion 83 is latched to the through hole 66 from the lower side.

The ink outlet 84 in the ink supply unit 70 is arranged between the unit first engagement portion 82 and the unit second engagement portion 83. This ensures the connection of the ink outlet 84 and the ink inlet 51.

The single terminal unit 71 is mounted on the cartridge holder 37 so that the terminal members 75 correspond to the electrical connection portions 46. In the terminal unit 71, each engaging portion 74 is engaged with the restriction portion 43*b* of the corresponding lever 43, and each unit positioning portion 79 is inserted into and positioned in the corresponding through hole 66. In this case, the latch hook 79*a* of the unit positioning portion 79 is latched to the through hole 66 from the lower side.

The restriction portions 43*b* at the engaging portions 74 restrict upward movement of the terminal unit 71, and the unit positioning portions 79 are positioned by the corresponding through holes 66. This maintains the connection of the terminal members 75 and the electrical connection portions 46 located between the engaging portions 74 and the unit positioning portions 79 in a preferred manner. The printer 12 (multifunction machine 11) reads predetermined information from the terminal members 75. Thus, the printer 12 performs printing, that is, ejects ink from the ink ejection head 33.

Subsequently, the tubes 17 extending from the ink tanks 18 are connected to the ink supply needles 96 of the ink supply unit 70 when the six ink supply units 70 and the single terminal unit 71 have been mounted on the cartridge holder 37. Then, ink is supplied from the ink tanks 18 to the ink ejection head 33 through the tubes 17 and the ink supply units 70.

Here, the ensured connection of the ink outlets 84 of the ink supply units 70 and the ink inlets 51 of the cartridge holder 37 smoothly supply ink from the ink supply units 70 to the ink ejection head 33. The supplied ink is thus ejected onto the paper P on the support board 31 from the ink ejection head 33 to perform printing on the paper P.

In this manner, in the printer 12 of the present embodiment, the mounting of the terminal unit 71 on the cartridge holder 37 ejects ink from the ink ejection head 33 even when the ink is supplied from the ink supply units 70, which do not include the terminal members 75 corresponding to the electrical connection portions 46, through the ink inlets 51 to the ink ejection head 33.

When performing printing on the paper P, the printer 12 stops printing when recognizing that the ink cartridge 36 contains no ink from the ink remaining amount information of each terminal member 75. In such a case, when the user pushes the reset button 80 of the terminal unit 71, the connection of some terminals 76 of the terminal group 77 in each terminal member 75 and the movable contact portion 49 of each electrical connection portion 46 is electrically interrupted.

The printer 12 recognizes removal of the terminal unit 71 from the cartridge holder 37. When the user pushes the reset button 80 of the terminal unit 71, some terminals 76 of the terminal group 77 in each terminal member 75 are electrically reconnected to the movable contact portion 49 of each electrical connection portion 46 again. As a result, the printer 12 recognizes the attachment of a new ink cartridge 36 onto the cartridge holder 37 and performs replacement cleaning, which cleans the ink ejection head 33 when the ink cartridge 36 is replaced.

The embodiment described above in detail has the following advantages.

(1) The terminal unit 71 is mounted on the cartridge holder 37 under a situation in which the engaging portions 74 restrict movement in the upward direction (removal direction of ink cartridges 36) and the unit positioning portions 79 are positioned by the through holes 66 at the side closer to the inclined surfaces 64 than the ink inlets 51. Thus, the terminals 76 of the terminal group 77 in each terminal member 75 are connected to the movable contact portion 49 of the corresponding electrical connection portion 46 in a compact structure in a satisfactory manner. By mounting the terminal unit 71 on the cartridge holder 37, the ink ejection head 33 can eject ink supplied from the ink supply units 70, which do not include the terminal members 75 corresponding to the electrical connection portion 46 of the cartridge holder 37, through the ink inlet 51.

(2) In the terminal unit 71, each terminal member 75 is arranged between each engaging portion 74 and the unit positioning portion 79 in the front-rear direction Y. Thus, when the terminal unit 71 is mounted on the cartridge holder 37, each engaging portion 74 is engaged with and restrained by the restriction portion 43*b* of the lever 43 and each unit positioning portion 79 is positioned by each through hole 66. This ensures accurate connection of the electrical connection portions 46 and the terminal members 75.

(3) When the terminal unit 71 is mounted on the cartridge holder 37, the unit positioning portions 79 of the terminal unit 71 are latched to the through holes 66. This restricts separation of the terminal unit 71 from the cartridge holder 37.

(4) In the cartridge holder 37, six ink inlets 51 and six electrical connection portions 46 are arranged in the same direction (lateral direction X). Further, six terminal members 75 of the terminal unit 71 are arranged next to one another in the same direction as the direction (lateral direction X) in which the electrical connection portions 46 are arranged to correspond to the electrical connection portions 46. Thus, the connection of the six electrical connection portions and the six terminal members 75 is achieved by a single operation in which the terminal unit 71 is mounted on the cartridge holder 37. This increases the efficiency for mounting the terminal unit 71 on the cartridge holder 37.

(5) In the terminal unit 71, the number of unit positioning portions 79 is less than the number of terminal members 75 (number of terminal groups 77). Thus, the locations where the unit positioning portions 79 and the through holes 66 are positioned is reduced compared to when the number of the unit positioning portions 79 is the same as the number of the terminal members 75.

(6) In the terminal unit 71, the unit positioning portions 79 are arranged on the two opposite sides of the four inner terminal members 75 in the lateral direction X, which is the direction in which the terminal members 75 are arranged. When mounting the terminal unit 71 on the cartridge holder 37, the terminal members 75 located between the two unit positioning portions 79 in the direction in which the terminal members 75 are arranged are accurately connected to the electrical connection portions 46.

(7) The terminal unit 71 includes the reset button 80 that electrically interrupts the connection of some terminals 76 of the terminal group 77 in each terminal member 75 and the movable contact portions 49 of the electrical connection portion 46 based on an external operation. Thus, the user only needs to push the reset button 80 to interrupt the connection of some terminals 76 of the terminal group 77 in the terminal members 75 and the movable contact portions 49 of the electrical connection portions 46. This allows the printer 12 to recognize removal of the terminal unit 71 from the cartridge holder 37 without removing the terminal unit 71 from the cartridge holder 37. Therefore, even when printing is performed on the paper P with the ink from the ink tanks 18 and not the ink cartridges 36, the printer 12 is able to perform replacement cleaning, which would be performed during replacement of an ink cartridge when the ink cartridge 36 is removed from and attached to the cartridge holder 37.

(8) When the terminal unit 71 is mounted on the cartridge holder 37, the unit positioning portions 79 of the terminal unit 71 are engaged with the accommodation unit positioning portions, which are the through holes 66 in the inner bottom surface 38*b* of the accommodation unit 38. Thus, the accommodation unit positioning portions may be easily formed, and the engagement of the unit positioning portions 79 and the accommodation unit positioning portions (through hole 66) ensure connection of the terminal members 75 and the electrical connection portions 46.

(9) The ink supply unit 70 includes the unit first engagement portion 82 that engages the recess 54, the unit second engagement portion 83 that engages the through hole 66, the ink outlet 84 that is arranged between the unit first engagement portion 82 and the unit second engagement portion 83 and is connectable to the ink inlet 51, and the ink supply passage 94 that is in communication with the ink outlet 84. Thus, ink may be supplied to the ink inlet 51 without the ink cartridges 36 by mounting the ink supply unit 70 on the cartridge holder 37. The ink supply unit 70 includes the ink outlet 84 between the unit first engagement portion 82 and the unit second engagement portion 83. Thus, when the ink supply unit 70 is mounted on the cartridge holder 37, the unit first engagement portion 82 is engaged with the recess 54, and the unit second engagement portion 83 is engaged with the through hole 66. This ensures connection of the ink outlet 84 of the ink supply unit 70 and the ink inlet 51 of the cartridge holder 37. Thus, ink is smoothly supplied to the ink inlet 51.

(10) The ink supply unit 70 includes the hollow ink supply needle 96, which is the connection portion connectable to the tube 17 for supplying ink from the outside of the accommodation unit 38 to the ink supply passage 94. Thus, the connection of the tube 17 to the ink supply needle 96 allows ink to be supplied from the ink tank 18, which has a larger capacity than the ink cartridge 36 and is located outside the accommodation unit 38 (printer 12), to the ink supply passage 94 through the tube 17. Further, the connection portion is configured by the hollow ink supply needle 96. Thus, in addition to the tube 17, a cartridge adapter including an ink outlet port sealed by a seal member formed by a film, rubber, or the like may be connected to the connection portion.

(11) The ink supply unit 70 includes the unit filter 87 that comes into planar contact with the ink inlet 51 when mounted on the cartridge holder 37. Further, the porous member 88 and the spring member 89, which biases the porous member 88 toward the ink inlet 51, are arranged at the inner side of the unit filter 87. Thus, the spring member 89 biases the unit filter 87 toward the ink inlet 51 through the porous member 88. This stably pushes the unit filter 87 against the ink inlet 51. Therefore, ink may be smoothly supplied from the ink outlet 84 of the ink supply unit 70 to the ink inlet 51 of the cartridge holder 37.

Modified Examples

The embodiment described above may be modified in the following manner.

Figure 15:
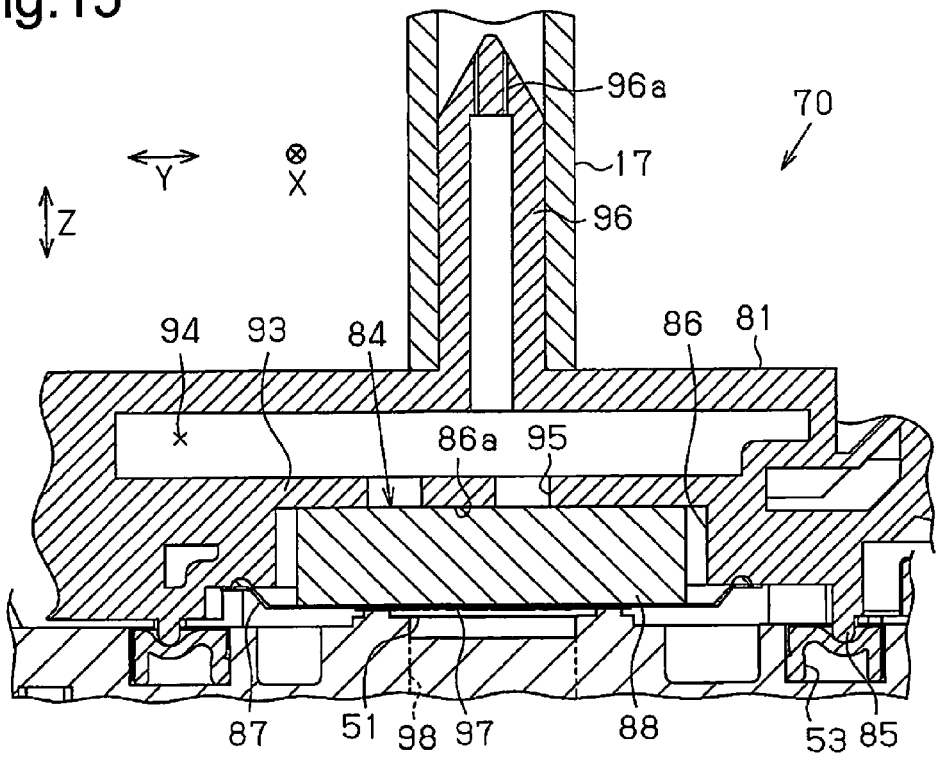
FIG. 15 is an enlarged cross-sectional view of a main portion showing when an ink supply unit is mounted on a cartridge holder in a modified example.

As shown in FIG. 15, in the ink supply unit 70, the spring member 89 may be omitted, and the thickness of the porous member 88 may be changed so that the upper surface of the porous member 88 contacts the inner bottom surface 86*a* of the supply recess 86. In this case, the elasticity of the porous member 88 biases the unit filter 87 toward the ink inlet 51 so that the unit filter 87 can be stably pushed against the ink inlet 51 without using the spring member 89. Ink can thus be smoothly supplied from the ink outlet 84 of the ink supply unit 70 to the ink inlet 51 of the cartridge holder 37.

Figure 16:
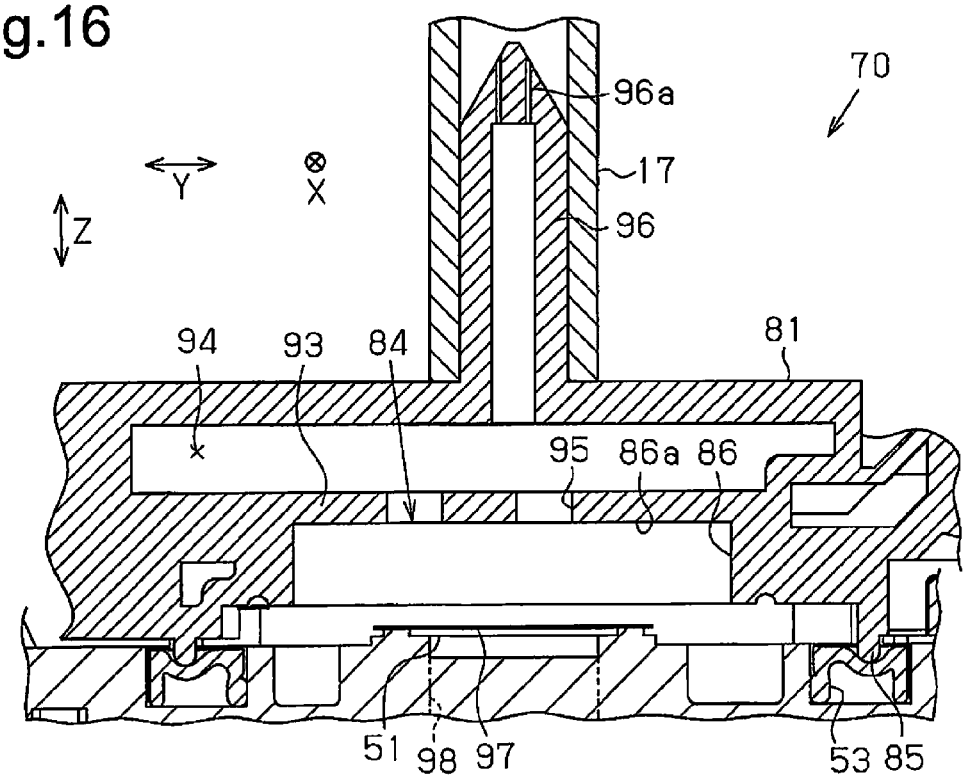
FIG. 16 is an enlarged cross-sectional view of a main portion showing when an ink supply unit is mounted on a cartridge holder in another modified example.

As shown in FIG. 16, the unit filter 87, the porous member 88, and the spring member 89 may be omitted in the ink supply unit 70.

Figure 17:
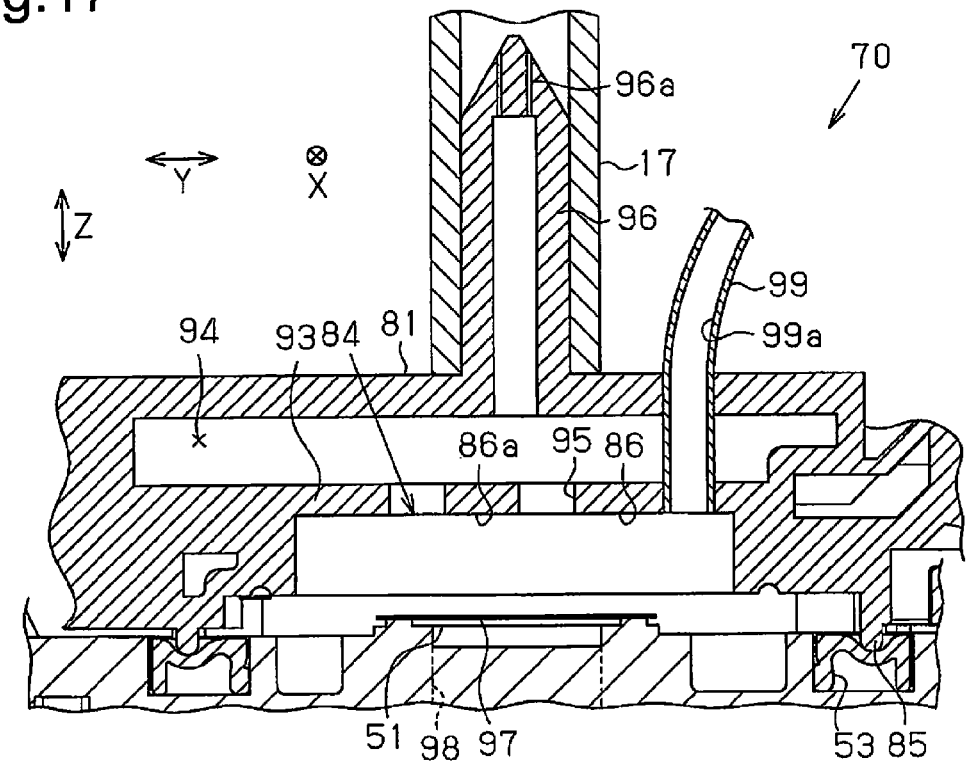
FIG. 17 is an enlarged cross-sectional view of a main portion showing when an ink supply unit is mounted on a cartridge holder in a further modified example.

As shown in FIG. 17, the ink supply unit 70 may include an air discharge tube 99, which includes an air discharge passage 99*a* for discharging air out of the ink supply passage 94. This draws in air from the supply recess 86, which is in communication with the ink supply passage 94, through the air discharge passage 99*a* and eliminates air from the ink in the supply recess 86 and the ink supply passage 94.

Figure 18A:
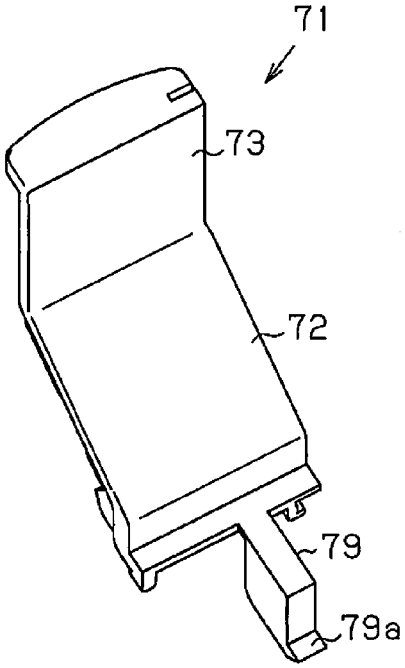
FIG. 18A is a perspective view of a terminal unit taken from an upper side in a modified example.
Figure 18B:
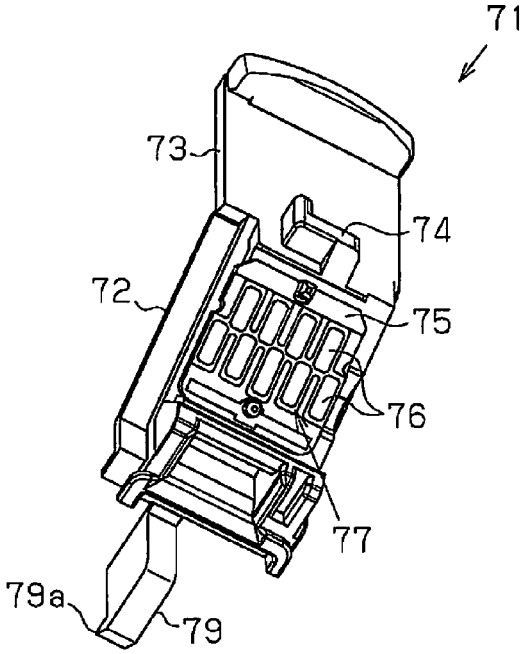
FIG. 18B is a perspective view of the terminal unit taken from a lower side.

As shown in FIGS. 18A and 18B, the terminal unit 71 may be divided into parts corresponding to the electrical connection portions 46 of the cartridge holder 37. Preferably, in this case, the reset button 80 is provided for each divided part of the terminal unit 71. The terminal unit 71 may be divided into any number of parts, such as two or three parts.

Figure 19A:
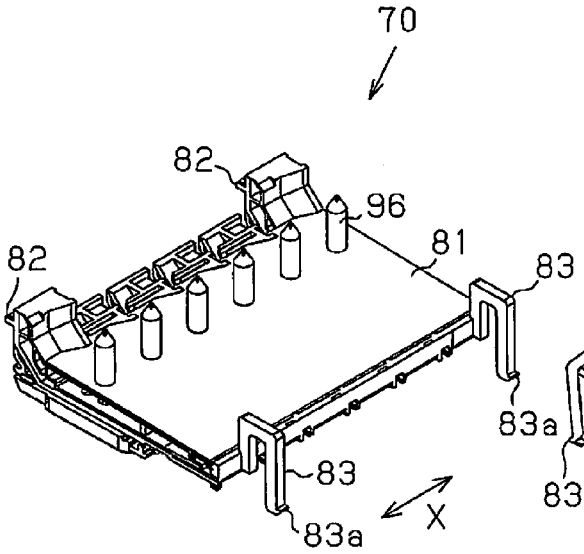
FIG. 19A is a perspective view of an ink supply unit taken from an upper side in a modified example.
Figure 19B:
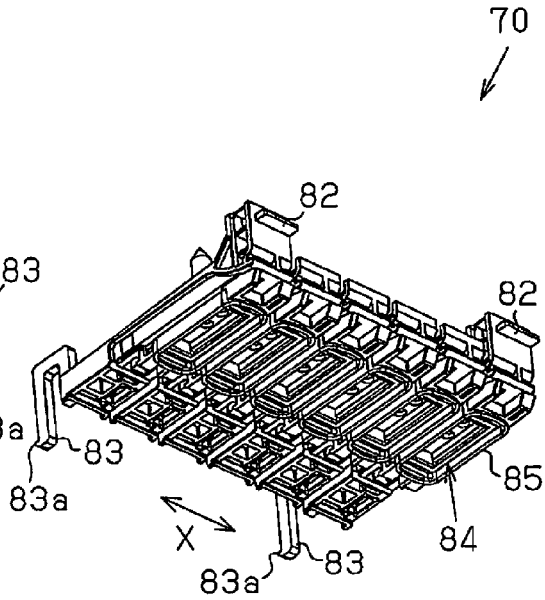
FIG. 19B is a perspective view of the ink supply unit taken from a lower side.

As shown in FIGS. 19A and 19B, the six ink supply units 70 may be formed integrally in correspondence with every one of the ink inlets 51 in the cartridge holder 37. Preferably, in this case, the unit first engagement portion 82 and the unit second engagement portion 83 are each arranged on each of the two ends of the ink supply unit 70 in the lateral direction X.

Figure 20:
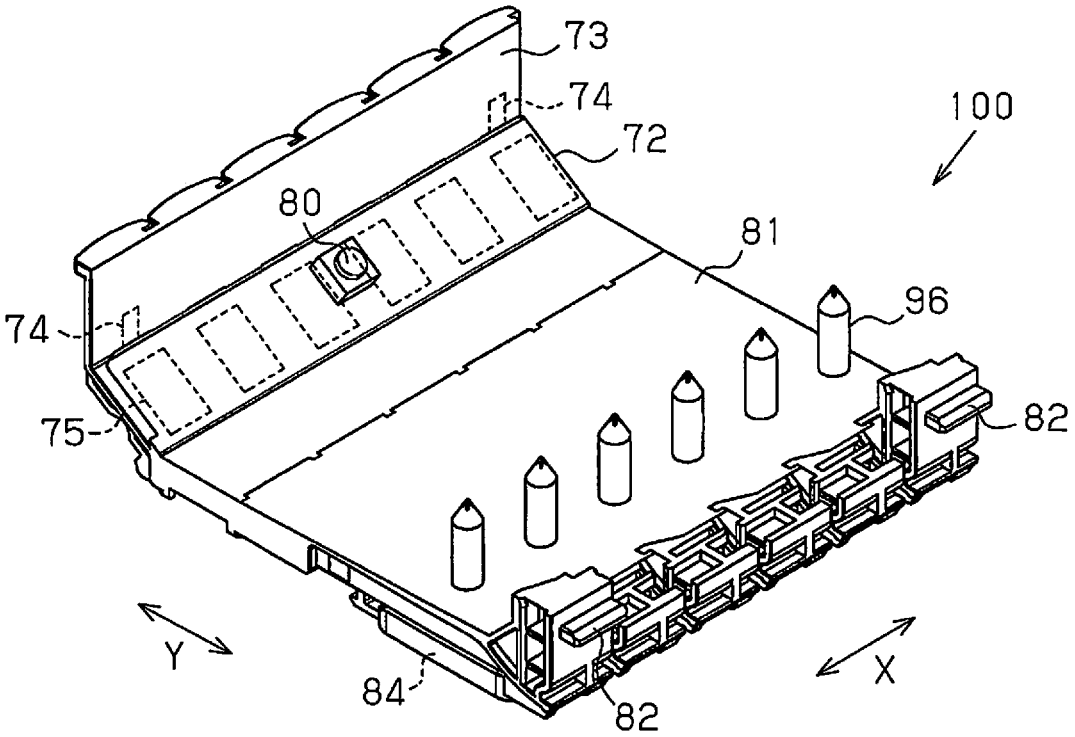
FIG. 20 is a perspective view of an adapter configured by combining the ink supply unit and the terminal unit in a modified example.

As shown in FIG. 20, an adapter 100 may be configured by integrally forming and connecting the unit positioning portions 79 of the terminal unit 71 shown in FIG. 10 and the unit second engagement portions 83 of the ink supply unit 70 shown in FIGS. 19A and 19B. In this case, the inner four engaging portions 74 of the six engaging portions 74, which exclude the two at the two ends, the unit positioning portions 79, and the unit second engagement portions 83 are omitted. Further, the ink outlet 84 and the terminal member 75 (terminal group 77) are arranged between the engaging portion 74 and the unit first engagement portion 82 in the front-rear direction Y. Thus, the adapter 100 can fulfill the functions of both of the ink supply unit 70 and the terminal unit 71. More specifically, when the adapter 100 is mounted on the cartridge holder 37, each engaging portion 74 is engaged with and restrained by the restriction portion 43*b* of the corresponding lever 43, and each unit first engagement portion 82 is engaged with the corresponding recess 54. This allows for satisfactory connection of the ink inlets 51 and the ink outlets 84 and satisfactory connection of the electrical connection portions 46 and the terminal members 75. Furthermore, the adapter 100 having the functions of both of the ink supply unit 70 and the terminal unit 71 may be divided into any number of parts, such as one or two parts.

In the ink supply unit 70, a tubular portion, to which the tube 17 can be connected, may be used as the connection portion instead of the ink supply needle 96. Alternatively, a hole to which the tube 17 can be inserted may be used as the connection portion instead of the ink supply needle 96.

In the ink supply unit 70, the ink outlet 84 does not necessarily need to be arranged between the unit first engagement portion 82 and the unit second engagement portion 83 in the front-rear direction Y.

In the ink supply unit 70, the porous member 88 does not necessarily need to be elastic.

In the terminal unit 71, the number of engaging portions 74 may be less than the number of terminal members 75 (number of terminal groups 77). The number of locations where the engaging portions 74 and the levers 43 are engaged can thus be reduced compared to when the number of the engaging portions 74 is the same as the number of the terminal members 75. Therefore, when removing the terminal unit 71 from the cartridge holder 37, the locations where the engaging portions 74 and the restriction portions 43*b* of the levers 43 are disengaged can be reduced.

The terminal unit 71 may be configured such that the pushing of the reset button 80 separates and electrically or physically interrupts the connection of some terminals 76 of the terminal groups 77 of the terminal members 75 and the movable contact portions 49 of the electrical connection portions 46.

The terminal unit 71 may be configured such that the connection of all the terminals 76 of the terminal group 77 of each terminal member 75 and the movable contact portion 49 of each electrical connection portion 46 is electrically or physically shielded by pushing the reset button 80.

In the terminal unit 71, there may be only one unit positioning portion 79 or three or more unit positioning portions 79. If there is only one unit positioning portion 79, it is preferred that the unit positioning portion 79 be arranged at a central part of the terminal unit 71 in the lateral direction X.

In the terminal unit 71, the unit positioning portions 79 do not necessarily need to be arranged on both sides of the terminal member 75 (terminal group 77) in the lateral direction X.

The number of terminal members 75 (terminal group 77) located between the unit positioning portions 79 in the lateral direction X may be changed to any number in accordance with the location of the unit positioning portions 79 in the terminal unit 71.

In the terminal unit 71, the number of unit positioning portions 79 may be greater than or equal to the number of terminal members 75 (number of terminal groups 77).

In the terminal unit 71, the unit positioning portion 79 may be configured so that it can be fitted to the through hole 66.

In the terminal unit 71, the terminal member 75 (terminal group 77) does not necessarily need to be arranged between the engaging portion 74 and the unit positioning portion 79 in the front-rear direction Y.

The ink tank 18 may be arranged in the printer 12 as long as it is outside the accommodation unit 38.

The recess 54 may be changed to a through hole serving as an accommodation unit restriction portion.

The printer 12 may be a line printer.

DESCRIPTION OF REFERENCE CHARACTERS

17: tube, 33: ink ejection head, 36: ink cartridge, 37: cartridge holder, 38: accommodation unit, 38*b*: inner bottom surface, 43: lever, 43*b*: restriction portion, 46: electrical connection portion, 51: ink inlet, 54: recess serving as example of accommodation unit restriction portion, 64: inclined surface, 66: through hole serving as example of accommodation unit positioning portion and accommodation unit engagement portion, 70: ink supply unit, 71: terminal unit, 74: engaging portion, 76: terminal, 77: terminal group, 79: unit side positioning portion, 80: reset button serving as example of interruption unit, 82: unit first engagement portion, 83: unit second engagement portion, 84: ink outlet, 87: unit filter (filter), 88: porous member, 89: spring member serving as example of biasing member, 94: ink supply passage, 96: ink supply needle serving as example of connection portion, 99*a*: air discharge passage, 100: adapter.

What is claimed is:

1. A terminal unit that is mountable on a cartridge holder including an ink inlet, which draws in ink supplied to an ink ejection head and is located in an inner bottom surface of an accommodation unit that is capable of accommodating an ink cartridge, an electrical connection portion, which is arranged on an inclined surface extending in a direction intersecting the inner bottom surface in the accommodation unit, an accommodation unit positioning portion, which is arranged between the inclined surface and the ink inlet in the accommodation unit, and a lever including a restriction portion capable of restricting movement of the ink cartridge when accommodated in the accommodation unit in a direction in which the ink cartridge is removed from the accommodation unit, the terminal unit comprising:

a terminal group configured and arranged to be in contact with the electrical connection portion when the terminal unit is mounted on the cartridge holder;

an engaging portion configured and arranged to be engaged with the restriction portion of the lever; and a unit positioning portion engaged to the accommodation unit positioning portion formed in the inner bottom surface of the accommodation unit.

2. The terminal unit according to claim 1, wherein the terminal group is arranged between the engaging portion and the unit positioning portion.

3. The terminal unit according to claim 1, wherein the unit positioning portion is engaged with and restrained by the accommodation unit positioning portion.

4. The terminal unit according to claim 1, wherein two or more ink inlets and two or more electrical connection portions are arranged in the same direction in the cartridge holder; and two or more terminal groups are arranged in the same direction as the direction the electrical connection portions are arranged in correspondence with the electrical connection portions.

5. The terminal unit according to claim 4, wherein the number of engaging portions is less than the number of terminal groups.

6. The terminal unit according to claim 4, wherein the number of unit positioning portions is less than the number of terminal groups.

7. The terminal unit according to claim 4, wherein the unit positioning portion is arranged on two opposite sides of at least one of the terminal groups in the direction in which the terminal groups are arranged.

8. The terminal unit according to claim 1, further comprising an interruption unit that interrupts connection of at least some terminals of the terminal group and the electrical connection portion based on an external operation.

9. The terminal unit according to claim 1, wherein the unit positioning portion is configured and arranged to be engaged with the accommodation unit positioning portion, which is a through hole formed in the inner bottom surface of the accommodation unit.

10. The terminal unit according to claim 1, wherein the unit positioning portion is engaged to a through hole formed in the inner bottom surface of the accommodation unit, the through hole is configured to be used to determine presence of the ink in the ink cartridge when accommodated in the accommodation unit.

11. An ink supply unit that is mountable on a cartridge holder including an ink inlet, which draws in ink supplied to an ink ejection head and is located in an inner bottom surface of an accommodation unit that is capable of accommodating an ink cartridge, an accommodation unit restriction portion, which restricts movement of the ink cartridge in a removal direction and is arranged on a side surface intersecting the inner bottom surface in the accommodation unit, and an accommodation unit engagement portion, which is arranged so that the accommodation unit engagement portion and the accommodation unit restriction portion are located at opposite sides of the ink inlet in the inner bottom surface, the ink supply unit comprising:

a unit first engagement portion engageable with the accommodation unit restriction portion;

a unit second engagement portion engageable with the accommodation unit engagement portion formed in the inner bottom surface of the accommodation unit;

an ink outlet located between the unit first engagement portion and the unit second engagement portion, wherein the ink outlet is connectable to the ink inlet; and an ink supply passage that is in fluid communication with the ink outlet.

12. The ink supply unit according to claim 11, further comprising a connection portion connectable to a tube that supplies ink to the ink supply passage from outside the accommodation unit.

13. The ink supply unit according to claim 12, wherein the connection portion is configured by a hollow ink supply needle.

14. The ink supply unit according to claim 11, further comprising:

a filter that comes into planar contact with the ink inlet when the ink supply unit is mounted on the cartridge holder; and a porous member and a biasing member, which biases the porous member toward the ink inlet, arranged at an inner side of the filter.

15. The ink supply unit according to claim 11, further comprising:

a filter that comes into planar contact with the ink inlet when the ink supply unit is mounted on the cartridge holder; and an elastic porous member arranged at an inner side of the filter.

16. The ink supply unit according to claim 11, further comprising an air discharge passage that discharges air out of the ink supply passage.

17. The ink supply unit according to claim 10, wherein the unit second engagement portion is engageable with a through hole formed in the inner bottom surface of the accommodation unit, the through hole is configured to be used to determine presence of the ink in the ink cartridge when accommodated in the accommodation unit.

18. An adapter that is mountable on a cartridge holder including an ink inlet that draws in ink supplied to an ink ejection head and is arranged on an inner bottom surface of an accommodation unit capable of accommodating an ink cartridge, an electrical connection portion arranged on an inclined surface extending in a direction intersecting the inner bottom surface in the accommodation unit, an accommodation unit restriction portion that restricts movement of the ink cartridge in a removal direction and is arranged on a side surface intersecting the inner bottom surface in the accommodation unit, and a lever including a restriction portion capable of restricting movement of the ink cartridge when accommodated in the accommodation unit in a direction in which the ink cartridge is removed from the accommodation unit, the adapter comprising:

an ink outlet connected to the ink inlet when the adapter is mounted on the cartridge holder;

a terminal group configured and arranged to be in contact with the electrical connection portion;

an engaging portion configured and arranged to be engaged with the restriction portion of the lever; and a unit first engagement portion configured and arranged to be engaged with the accommodation unit restriction portion;

wherein the ink outlet and the terminal group are arranged between the engaging portion and the unit first engagement portion, wherein the adapter is mounted on the cartridge holder instead of the cartridge, wherein the ink is drawn in from outside the accommodation unit.

* * * * *